US009260264B2

(12) United States Patent
Hoshino et al.

(10) Patent No.: US 9,260,264 B2
(45) Date of Patent: Feb. 16, 2016

(54) SHEET DISCHARGING DEVICE, IMAGE FORMING SYSTEM, AND SHEET DISCHARGING METHOD

(71) Applicants: Tomomichi Hoshino, Kanagawa (JP); Masahiro Tamura, Kanagawa (JP); Shuuya Nagasako, Kanagawa (JP); Tomohiro Furuhashi, Kanagawa (JP); Keisuke Sugiyama, Tokyo (JP); Kyosuke Nakada, Kanagawa (JP); Kazuya Yamamoto, Kanagawa (JP); Akira Kunieda, Tokyo (JP); Takahiro Watanabe, Kanagawa (JP); Junya Suzuki, Miyagi (JP); Kazunori Konno, Miyagi (JP); Youhei Niitsuma, Miyagi (JP); Takamasa Matsumoto, Miyagi (JP); Kiichiro Goto, Kanagawa (JP); Kazuhiko Kitano, Miyagi (JP); Takashi Fukumoto, Miyagi (JP); Yasuo Niikura, Miyagi (JP); Satoru Takano, Miyagi (JP); Hidetoshi Kojima, Miyagi (JP); Kei Sasaki, Miyagi (JP); Yasushi Tsuruoka, Miyagi (JP); Shintaro Matsumoto, Miyagi (JP); Ryo Takahashi, Miyagi (JP); Yuuta Mori, Miyagi (JP); Kohjiroh Haga, Miyagi (JP)

(72) Inventors: Tomomichi Hoshino, Kanagawa (JP); Masahiro Tamura, Kanagawa (JP); Shuuya Nagasako, Kanagawa (JP); Tomohiro Furuhashi, Kanagawa (JP); Keisuke Sugiyama, Tokyo (JP); Kyosuke Nakada, Kanagawa (JP); Kazuya Yamamoto, Kanagawa (JP); Akira Kunieda, Tokyo (JP); Takahiro Watanabe, Kanagawa (JP); Junya Suzuki, Miyagi (JP); Kazunori Konno, Miyagi (JP); Youhei Niitsuma, Miyagi (JP); Takamasa Matsumoto, Miyagi (JP); Kiichiro Goto, Kanagawa (JP); Kazuhiko Kitano, Miyagi (JP); Takashi Fukumoto, Miyagi (JP); Yasuo Niikura, Miyagi (JP); Satoru Takano, Miyagi (JP); Hidetoshi Kojima, Miyagi (JP); Kei Sasaki, Miyagi (JP); Yasushi Tsuruoka, Miyagi (JP); Shintaro Matsumoto, Miyagi (JP); Ryo Takahashi, Miyagi (JP); Yuuta Mori, Miyagi (JP); Kohjiroh Haga, Miyagi (JP)

(73) Assignee: RICOH COMPANY, LIMITED, Tokyo (JP)

( * ) Notice: Subject to any disclaimer, the term of this patent is extended or adjusted under 35 U.S.C. 154(b) by 6 days.

(21) Appl. No.: 14/222,984

(22) Filed: Mar. 24, 2014

(65) Prior Publication Data

US 2014/0203501 A1 Jul. 24, 2014

Related U.S. Application Data

(62) Division of application No. 13/782,118, filed on Mar. 1, 2013.

(30) Foreign Application Priority Data

Mar. 2, 2012 (JP) ..... 2012-046726
Dec. 21, 2012 (JP) ..... 2012-279960

(51) Int. Cl.

| | |
|---|---|
| ***B65H 31/26*** | (2006.01) |
| ***B65H 29/24*** | (2006.01) |
| ***B65H 31/10*** | (2006.01) |
| ***B65H 31/36*** | (2006.01) |
| ***B65H 31/38*** | (2006.01) |
| ***G03G 15/00*** | (2006.01) |

(52) U.S. Cl.

CPC ..... *B65H 29/246* (2013.01); *B65H 31/10* (2013.01); *B65H 31/26* (2013.01); *B65H 31/36* (2013.01); *B65H 31/38* (2013.01); *G03G 15/6552* (2013.01); *B65H 2301/4461* (2013.01); *B65H 2404/1118* (2013.01); *B65H 2406/121* (2013.01); *B65H 2406/122* (2013.01); *B65H 2406/14* (2013.01); *B65H 2406/422* (2013.01); *B65H 2407/51* (2013.01); *B65H 2511/10* (2013.01); *B65H 2511/13* (2013.01); *B65H 2511/222* (2013.01); *B65H 2511/416* (2013.01); *B65H 2513/514* (2013.01); *B65H 2601/261* (2013.01)

(58) Field of Classification Search

CPC ..... B65H 29/246; B65H 2301/4212; B65H 31/34; B65H 2801/21; B65H 29/041
USPC ..... 271/207, 209, 211, 97, 220
See application file for complete search history.

(56) References Cited

U.S. PATENT DOCUMENTS

| | | | | |
|---|---|---|---|---|
| 1,465,385 | A * | 8/1923 | White | B65H 29/041 271/211 |
| 3,502,407 | A * | 3/1970 | Ellis | G03G 15/6552 226/97.1 |
| 4,811,547 | A | 3/1989 | Raats et al. | |
| 5,324,024 | A * | 6/1994 | Mori | B65H 29/246 271/211 |
| 6,522,841 | B2 * | 2/2003 | Horikoshi | B65H 29/14 271/211 |
| 6,955,348 | B2 * | 10/2005 | Koga | B65H 3/128 271/97 |
| 7,283,776 | B2 | 10/2007 | Oba | |
| 7,556,262 | B2 * | 7/2009 | Mizuno | B65H 3/06 271/207 |
| 7,708,264 | B2 * | 5/2010 | Kosugi | B65H 3/128 271/97 |
| 7,913,993 | B2 | 3/2011 | Kosugi et al. | |
| 7,941,088 | B2 * | 5/2011 | Suzuki | G03G 15/6538 399/405 |
| 8,336,877 | B2 * | 12/2012 | Yamamoto | B65H 29/14 271/200 |
| 2002/0063380 | A1 | 5/2002 | Tamura et al. | |
| 2002/0079642 | A1 | 6/2002 | Tamura et al. | |
| 2002/0158405 | A1 | 10/2002 | Nagasako et al. | |
| 2005/0285326 | A1 | 12/2005 | Uji et al. | |
| 2006/0170145 | A1 | 8/2006 | Nakane | |
| 2006/0181006 | A1 * | 8/2006 | Funada | B65H 9/106 271/207 |
| 2007/0130113 | A1 * | 6/2007 | Ting | 707/2 |
| 2007/0130339 | A1 * | 6/2007 | Alcorn et al. | 709/225 |
| 2007/0133886 | A1 * | 6/2007 | Berretty et al. | 382/232 |
| 2007/0147793 | A1 * | 6/2007 | Tabuchi et al. | 386/120 |
| 2007/0216083 | A1 * | 9/2007 | Kawashima et al. | 271/97 |
| 2009/0014946 | A1 * | 1/2009 | Nagura | B65H 31/18 271/220 |
| 2010/0025928 | A1 | 2/2010 | Yamamoto et al. | |
| 2011/0187038 | A1 | 8/2011 | Heise et al. | |

FOREIGN PATENT DOCUMENTS

| | | | |
|---|---|---|---|
| CN | 1782926 | A | 6/2006 |
| JP | 60056766 | A * | 4/1985 |
| JP | 63171764 | | 7/1998 |
| JP | 2001-242769 | | 9/2001 |
| JP | 2003-002500 | A | 1/2003 |
| JP | 2004-043113 | A | 2/2004 |
| JP | 2006-103839 | A | 4/2006 |
| JP | 2006-199503 | A | 8/2006 |
| JP | 2010-137963 | A | 6/2010 |
| JP | 2011-057313 | | 3/2011 |

OTHER PUBLICATIONS

U.s. Office Action for corresponding U.S. Appl. No. 13/782,118 mailed Jul. 9, 2014.

Chinese Office Action and Search Report for Chinese Application No. 201310067491.7 dated Feb. 28, 2015 and English translation thereof.

Office Action for corresponding Japanese Application No. 2012-279960 dated May 26, 2015.

* cited by examiner

*Primary Examiner* — Prasad Gokhale

(74) *Attorney, Agent, or Firm* — Harness, Dickey & Pierce, P.L.C.

(57) ABSTRACT

A sheet discharging device includes a shift tray 202 on which a sheet P1 is stacked, a discharging roller 6 that discharges a sheet P2 onto the shift tray 202, a blowing device 230 that sends air to a lower surface of the sheet P2 discharged by the discharging roller 6, a blocking member 231 that blocks air sent to the lower surface of the sheet P2 from a blowing port 230-2 of the blowing device 230, and a control unit that controls the blocking amount of the blocking member 231. The blocking amount is determined based upon sheet information including sheet-type information, sheet-size information, and sheet-thickness information, for example.

19 Claims, 25 Drawing Sheets

SHEET DISCHARGING DEVICE, IMAGE FORMING SYSTEM, AND SHEET DISCHARGING METHOD

CROSS-REFERENCE TO RELATED APPLICATIONS

This application is a divisional of and claims priority under 35 U.S.C. §§120/121 to U.S. patent application Ser. No. 13/782,118, filed on Mar. 1, 2013, which claims priority to and incorporates by reference the entire contents of Japanese Patent Application No. 2012-046726 filed in Japan on Mar. 2, 2012 and Japanese Patent Application No. 2012-279960 filed in Japan on Dec. 21, 2012. The disclosures of each of the above applications are incorporated herein by reference in their entirety.

BACKGROUND OF THE INVENTION

1. Field of the Invention

The present invention relates to a sheet discharging device, an image forming system, and a sheet discharging method.

2. Description of the Related Art

Conventionally, there has widely been known a sheet processing apparatus that executes various post-processes, including alignment, binding, folding, and bookbinding, to a sheet discharged from an image forming apparatus, the sheet processing apparatus being referred to as a sheet post-processing apparatus because it executes the post-processes. The sheet processing apparatus described above has popularly been used. The sheet post-processing apparatus of this type has been greatly expected to handle variety of sheets in recent years. Especially, a color image forming apparatus frequently prints an image on a coated paper (hereinafter referred to as coat paper) that looks the image wonderful for a catalog or leaflet. The coat paper generally has characteristics of:

1) having high surface smoothness;
2) having strong adhesion force between papers; and
3) having low Clark stiffness.

Therefore, these characteristics might deteriorate a stacking property of the coat paper. Specifically, when sheets that have high surface smoothness or that are easy to be charged such as coat paper are discharged and stacked, the discharged sheet might be adsorbed on a stacking surface of a tray unit or on a stacked sheet, resulting in that the discharged sheet might be buckled, or the discharged sheet might push the stacked paper to deteriorate the stacking property.

In view of this, Japanese Laid-open Patent Publication No. 2011-057313 describes a sheet discharging device having a discharging unit that discharges a sheet having an image formed thereon in a sheet discharging direction; and a tray unit that successively stacks the sheets discharged by the discharging unit, the apparatus further including a blowing mechanism that can repeat an operation of blowing air to the back surface of the sheet, one by one, discharged by the discharging unit and of stopping the blowing operation just before the trailing end of the sheet completely passes through the discharging unit. In this invention, air is sent from an air blower located below the sheet discharging unit in order to form an air layer between the lower surface of the discharged sheet and the sheets that have already been stacked, whereby the stacking property is enhanced.

Japanese Laid-open Patent Publication No. 2001-242769 describes an image forming apparatus having an image forming unit that develops an electrostatic latent image formed on an image carrier with toner to form an image onto a sheet material; a sheet material tray unit that stacks the sheet material having the image formed by the image forming unit; and an air blower that evacuates air in the apparatus to the outside and that sends air to the sheet material stacked on the sheet material tray unit, the apparatus further including a control unit that controls a blowing condition of the air blower according to the state of the sheet material stacked on the sheet material tray unit, in order to stabilize the stacking property of the sheet materials on a discharge tray without causing stain on the sheet material or without causing a stacking trouble that means the sheet materials are adhered to each other on the discharge tray for the sheet materials having the image formed thereon.

However, on the sheet tray unit in the inventions described in Japanese Laid-open Patent Publication No. 2011-057313 and Japanese Laid-open Patent Publication No. 2001-242769, a stacking trouble might be caused by the change in the condition such as a type of a sheet, a size of a sheet, or a thickness of a sheet. Specifically, when air is sent from the air blower even after the discharged sheet completely passes through a nip of a discharging roller, the discharged sheet is blown by airflow, so that the drop position is not fixed. Accordingly, the stacking trouble might be caused. Since the air blower is always opened, foreign matters enter the apparatus, which might damage a mechanism in the apparatus.

Therefore, there is a need to secure a satisfactory stacking property upon discharging a sheet by blowing air, and to prevent foreign matters from entering a blowing port.

SUMMARY OF THE INVENTION

It is an object of the present invention to at least partially solve the problems in the conventional technology.

According to an embodiment, there is provided a sheet discharging device that includes a discharging unit configured to discharge a sheet; an air blower configured to blow air to a lower surface of the sheet discharged by the discharging unit; a blocking unit configured to block at least some of the air blown to the lower surface of the sheet from a blowing port of the air blower; and a control unit configured to controls the operation of the blocking unit.

According to another embodiment, there is provided an image forming system that includes the sheet discharging device according to the above embodiment.

According to still another embodiment, there is provided a sheet discharging method that includes discharging a sheet by a discharging unit; blowing air by an air blower to a lower surface of the sheet discharged by the discharging unit; and blocking, by a blocking unit, at least some of the air blown to the lower surface of the sheet from a blowing port of the air blower to control an amount of blocking the air. The blocking includes bringing the blocking unit into a closed state during a stand-by state for a discharge of the sheet; bringing the blocking unit into a state of blowing a predetermined volume of air while the sheet is discharged by the discharging unit; and bringing the blocking unit into a state of stopping the blowing of air by the air blower or reducing the air blown after the sheet completely passes through the discharging unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
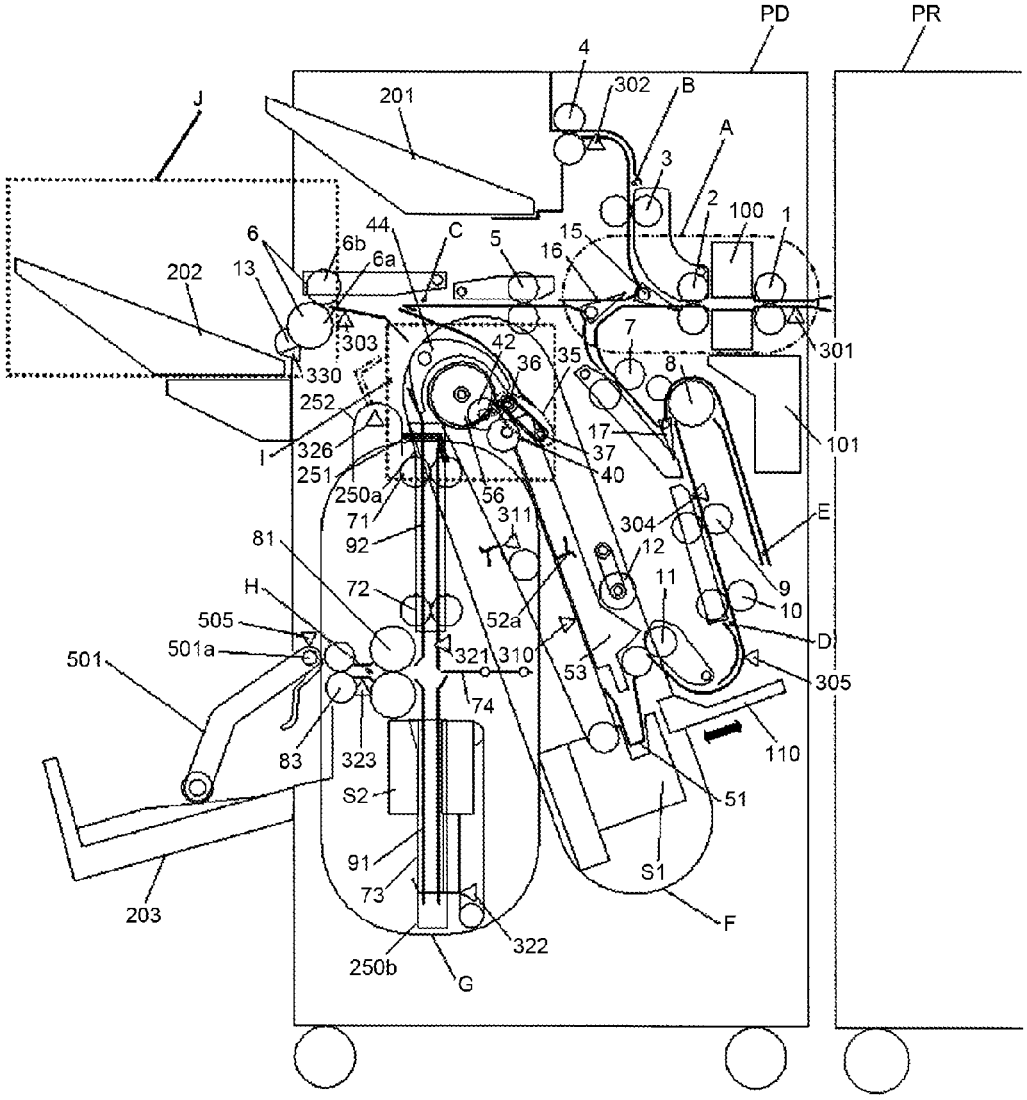
FIG. 1 is a view illustrating a configuration of an image forming system according to a first embodiment of embodiments of the present invention.

The present invention is characterized in that a blocking member is provided at the downstream side of an air blower, and air is sent from the air blower to a portion between a stacking tray or a sheet that has already been stacked and a lower surface of a sheet to be discharged, in order to realize satisfactory stacking property. Embodiments of the present invention will be described below with reference to the drawings.

In each embodiment, the same components or components regarded to be the same are identified by corresponding reference numerals, and the description will not be repeated as the case may be. In the embodiments described below, the term "sheet" means a sheet-like recording medium including a recording sheet, a transfer sheet, and an OHP sheet.

First Embodiment

FIG. 1 is a view illustrating a configuration of a system including a sheet post-processing apparatus PD serving as a sheet processing apparatus and an image forming apparatus PR according to a first embodiment of the embodiments of the present invention.

In FIG. 1, the image forming apparatus PR includes at least an image processing circuit, an optical writing device, a developing unit, a transfer unit, and a fixing unit. The image forming apparatus PR sends a sheet, having a toner image fixed thereon, to the sheet post-processing apparatus PD in order that desired post-processes are carried out by the sheet post-processing apparatus PD.

The image processing circuit converts inputted image data into image data that can be printed, and the optical writing device performs optical writing to a photosensitive element based upon an image signal outputted from the image processing circuit. The developing unit develops a latent image, formed on the photosensitive element by the optical writing, with toner, and the transfer unit transfers the toner image that is made visible by the developing unit onto a sheet. The fixing unit fixes the toner image transferred to the sheet by applying heat and pressure. The image forming apparatus PR uses electrophotography as described above. However, known image forming apparatuses using an inkjet system or thermal transfer system can all be used. In the present embodiment, the image processing circuit, the optical writing device, the developing unit, the transfer unit, and the fixing unit form an image forming unit.

The sheet post-processing apparatus PD is mounted at the side of the image forming apparatus PR. The sheet discharged from the image forming apparatus PR is guided to the sheet post-processing apparatus PD. The sheet post-processing apparatus PD has a conveying path A, a conveying path B, a conveying path C, a conveying path D, and a conveying path H. The sheet is firstly guided to the conveying path A having a post-processing unit (in this embodiment, a punch unit 100 serving as a punching unit) that performs a post-process to one sheet.

The conveying path B guides the sheet to an upper tray 201 through the conveying path A, and the conveying path C guides the sheet to a shift tray 202. The conveying path D guides the sheet to a process tray F (hereinafter also referred to as "end-face binding process tray" below) that performs an alignment, stapling process and the like. It is configured that the sheet is sorted to the conveying path B, C, or D from the conveying path A by a bifurcating claw 15 and a bifurcating claw 16.

The sheet post-processing apparatus can perform various processes, such as a punching process (punch unit 100), a sheet alignment+end binding process (jogger fence 53, end-face binding stapler S1), a sheet alignment+saddle-stitching process (saddle-stitching upper jogger fence 250*a*, saddle-stitching lower jogger fence 250*b*, saddle-stitching stapler S2), a sheet sorting process (shift tray 202), a center-folding process (folding plate 74, folding roller 81), to the sheet. Therefore, the conveying path A, as well as the conveying path B, the conveying path C, and the conveying path D that are subsequent to the conveying path A are selected. The conveying path D includes a sheet accommodating unit E, and at the downstream side of the conveying path D, the end-face binding process tray F, a saddle-stitching folding process tray G, and the discharge conveying path H are mounted.

The conveying path A that is common for the conveying path B, the conveying path C, and the conveying path D at their upstream side is provided with an inlet sensor 301 that detects a sheet accepted from the image forming apparatus PR, and is provided with, at its downstream side, an inlet roller 1, the punch unit 100, a punch crumb receiver 101, a conveying roller 2, and the first and second bifurcating claws 15 and 16 in this order. The first and second bifurcating claws 15 and 16 are held in a state (initial state) illustrated in FIG. 1 by a spring not illustrated. When first and second solenoids, not illustrated, are turned ON, the bifurcating claws 15 and 16 are driven respectively. In this case, the combination of the bifurcating directions of the first and second bifurcating claws 15 and 16 can be changed by selecting ON/OFF of the first and second solenoids, and according to the change in this combination, the sheet is sorted to the conveying path B, the conveying path C, or the conveying path D.

When the sheet is guided to the conveying path B, the state illustrated in FIG. 1 is kept, i.e., the first solenoid is turned OFF (the state of facing downward is the initial state of the first bifurcating claw 15). With this, the sheet is discharged onto the upper tray 201 from the conveying roller 3 through the discharging roller 4. When the sheet is guided to the conveying path C, the first and second solenoids are turned ON (the state of facing upward is the initial state of the second bifurcating claw 16) from the state in FIG. 1. With this, the bifurcating claw 15 swings upward, and the bifurcating claw 16 swings downward. Thus, the sheet is conveyed to the shift tray 202 through the conveying roller 5 and a pair of discharging rollers 6 (6*a*, 6*b*). In this case, the sheet is sorted.

The sheet is sorted on a shift tray discharging unit located at the most downstream side of the sheet post-processing apparatus PD. The shift tray discharging unit includes a pair of shift-discharging rollers 6 (6*a*, 6*b*), a returning roller 13, a sheet surface detecting sensor 330, the shift tray 202, a shift mechanism that is not illustrated and that allows the shift tray 202 to reciprocate in a direction orthogonal to the sheet conveying direction, and a shift tray lifting and lowering mechanism that lifts and lowers the shift tray 202.

When the sheet is guided to the conveying path D, the first solenoid that drives the first bifurcating claw 15 is turned ON, and the second solenoid that drives the bifurcating claw 16 is turned OFF. With this, the bifurcating claw 15 swings upward, and the bifurcating claw 16 swings upward, whereby the sheet is guided to the conveying path D from the conveying roller 2 through the conveying roller 7. The sheet guided to the conveying path D is guided to the end-face binding process tray F. The sheet that undergoes the alignment, stapling process and the like on the end-face binding process tray F is sorted by a guide member 44 to the conveying path C that guides the sheet to the shift tray 202 and to the saddle-stitching and folding process tray G (hereinafter also merely referred to as "saddle-stitching process tray" below) that performs the folding process and the like. When the sheet is guided to the shift tray 202, the sheet bundle is discharged to the shift tray 202 from the pair of discharging rollers 6. The sheet bundle guided to the saddle-stitching process tray G undergoes the folding and binding process on the saddle-stitching process tray G, and is discharged to a lower tray 203 from a discharging roller 83 via the discharge conveying path H.

On the other hand, a bifurcating claw 17 is arranged in the conveying path D, and it is held in a state illustrated in the figure by a low-load spring not illustrated. After the trailing end of the sheet conveyed by the conveying roller 7 passes through the bifurcating claw 17, at least the conveying roller 9 out of the conveying rollers 9 and 10, and a staple discharging roller 11 is rotated backward to allow the sheet to move backward along a turn guide 8. With this process, the sheet can be guided to the sheet accommodating unit E from the trailing end of the sheet, stayed (pre-stacked) thereon, superimposed on the next sheet, and then, conveyed. Two or more sheets can be conveyed as being superimposed with each other by repeating this operation. A pre-stack sensor 304 is mounted to set a backward feed operational timing upon pre-stacking the sheet.

When the sheet alignment and end-binding process are performed, the sheet is guided to the conveying path D, and the sheet guided to the end-face binding process tray F by the staple discharging roller 11 is successively stacked on the end-face binding process tray F. In this case, the trailing end of the sheet abuts against a reference fence 51, one by one, by a hammer roller 12, whereby the sheet is aligned in the vertical direction (in the sheet conveying direction). The sheet is also aligned in the lateral direction (the direction orthogonal to the sheet conveying direction; also referred to as a sheet widthwise direction) by the jogger fence 53. The end-face binding stapler S1 serving as the binding unit is driven by a staple signal from a control unit, not illustrated, on an intermission of the job, i.e., between the last sheet of the sheet bundle and the top sheet of the next sheet bundle, whereby the binding process is executed. The sheet bundle to which the binding process is executed is immediately sent to the shift-discharging roller 6 by an ejection belt 52 (see FIG. 2) provided with a projecting ejection claw 52*a*, and discharged onto the shift tray 202 set on a receiving position.

Figure 2:
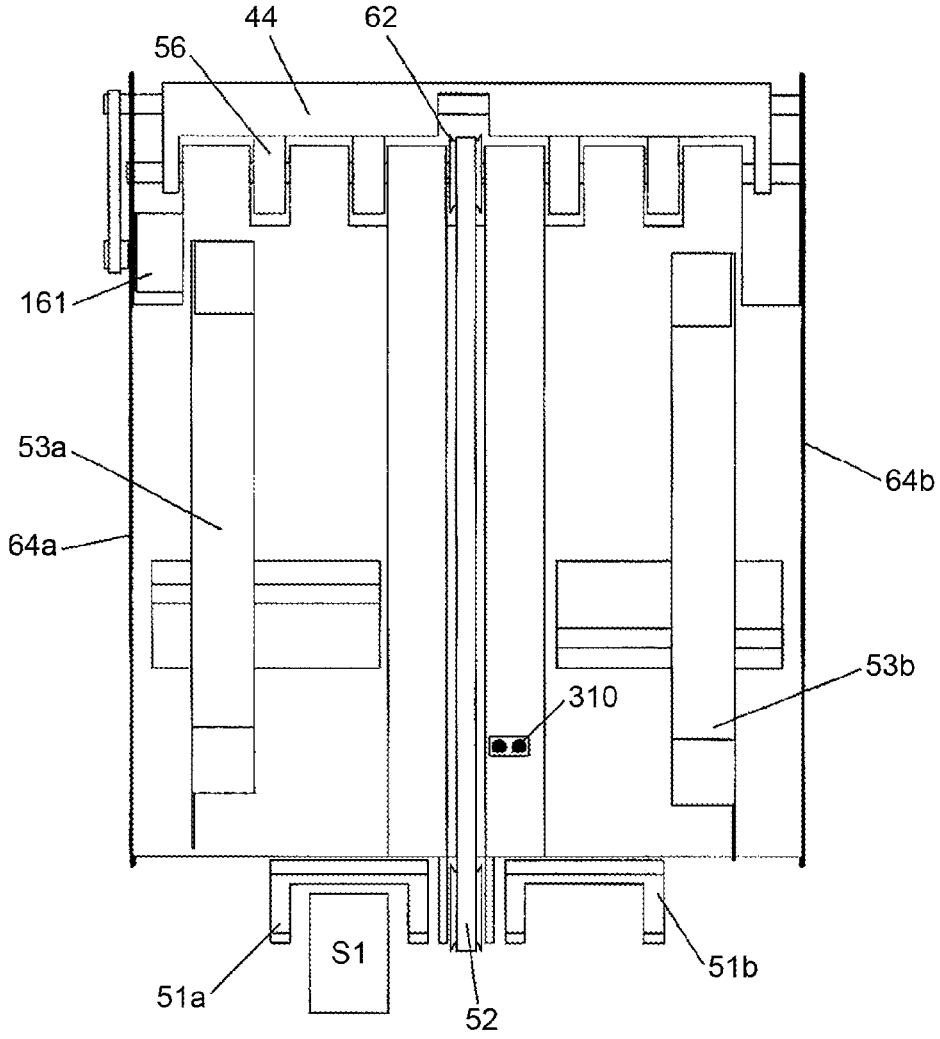
FIG. 2 is a view schematically illustrating a configuration of an end-face binding process tray in FIG. 1 viewed from a stacking surface of the tray.
Figure 4:
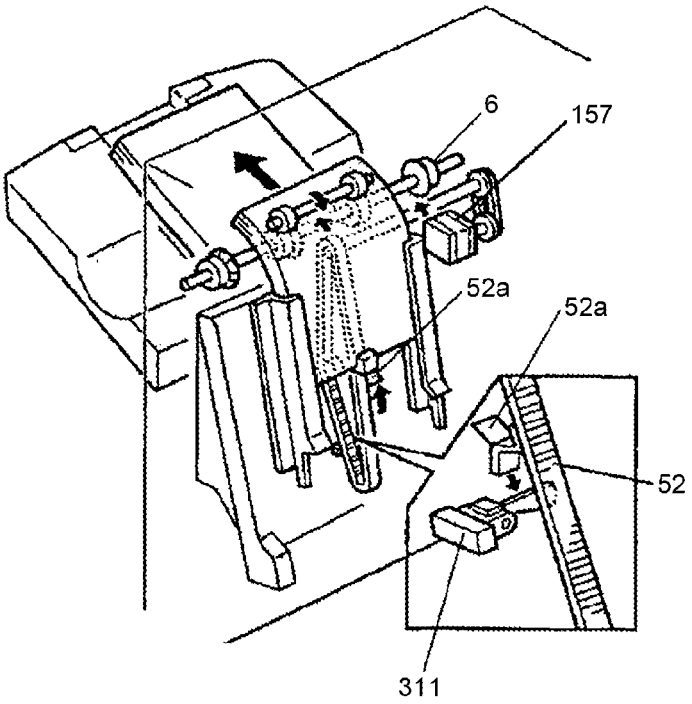
FIG. 4 is a perspective view illustrating an operation of an ejection belt.

As illustrated in FIGS. 2 and 4, the ejection belt 52 is located on the center of the alignment in the sheet widthwise direction. The ejection belt 52 is stretched between pulleys 62, and driven by an ejection belt drive motor 157. Plural ejection rollers 56 are arranged symmetric with respect to the ejection belt 52, and they are provided to be rotatable with respect to a driving shaft, and serve as driven rollers.

An ejection belt HP sensor 311 detects a home position of the ejection claw 52*a*. The ejection belt HP sensor 311 is turned on or off by the ejection claw 52*a* provided to the ejection belt 52. Two ejection claws 52*a* are arranged on the outer peripheral surface of the ejection belt 52 on opposite positions for alternately conveying the sheet bundle accommodated on the end-face binding process tray F. According to need, the ejection belt 52 is rotated backward to align the leading end of the sheet bundle, accommodated on the end-face binding process tray F, in the conveying direction by the back surface of the ejection claw 52*a* that is opposite to the ejection claw 52*a* waiting to move the sheet bundle.

In FIG. 1, a trailing end holding lever 110 is located on the lower end of the reference fence 51 in order to be capable of holding the trailing end of the sheet bundle accommodated on the reference fence 51. The trailing end holding lever 110 reciprocates in the direction almost perpendicular to the end-face binding process tray F. The sheet discharged onto the end-face binding process tray F is aligned one by one in the vertical direction (sheet conveying direction) by the hammer roller 12. However, when the trailing end of the sheet stacked on the end-face binding process tray F is curled, or has poor stiffness, the trailing end tends to be buckled and swelled by the weight of the sheet itself. When the number of the stacked sheets increases, a space for the next sheet in the reference fence 51 becomes small, so that the alignment in the vertical direction tends to be poor. A trailing end holding mechanism is provided in order to reduce the swell of the sheet on the trailing end for allowing the sheet to easily enter the reference fence 51, and the trailing end holding lever 110 directly holds the sheet.

In FIG. 1, sheet detection sensors 302, 303, 304, 305, and 310 respectively detect whether the sheet passes or not through the position where the respective sensors are provided, or whether the sheet is stacked or not.

Figure 6:
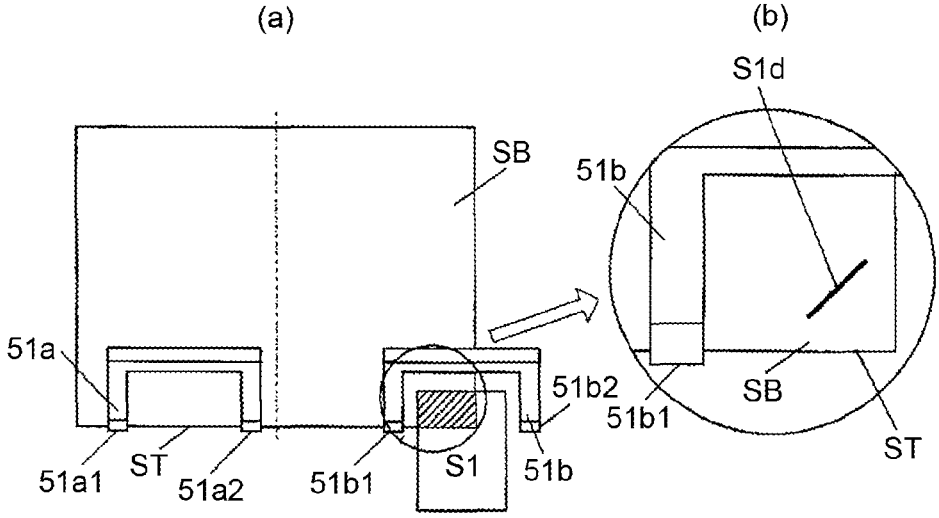
FIG. 6 illustrates a relationship among a sheet stacked onto the end-face binding process tray, a trailing end reference fence, and an end-face binding stapler during a binding process of an end face.

FIG. 2 is a view illustrating a schematic configuration of the end-face binding process tray F viewed from the stacking surface of the tray, and it corresponds to the view viewed from the right side in FIG. 1. In FIG. 2, the sheet accepted from the image forming apparatus PR on the upstream side is aligned in the widthwise direction by the jogger fences 53*a* and 53*b*, while the same sheet abuts against the first and second reference fences 51*a* and 51*b* (indicated as 51 in FIG. 1) to be aligned in the vertical direction. FIG. 6 illustrates a relationship among the sheet stacked onto the end-face binding process tray F, the reference fences 51*a* and 51*b*, and the end-face binding stapler S1 during the end-face binding process. As is understood from FIG. 6, the first and second reference fences 51*a* and 51*b* include stack surfaces 51*a*1, 51*a*2, 51*b*1, and 51*b*2 where the trailing end ST of the sheet abuts against the inner side thereof and is held thereon, whereby the trailing end ST of the sheet is supported. The trailing end ST can be supported on four points as apparent from FIG. 2. When the end-face binding stapler S1 staples the sheet diagonally on one point, the stapler S1 moves to the end of the stacked sheet bundle SB, and staples the sheet bundle as being inclined. Illustrated in (b) of FIG. 6 is the relationship between a stapler Sid that has already stapled the sheet and the trailing end fence 51*b*. In this case, the sheet bundle SB is stacked as being in contact with any two of the stack surfaces 51*a*1, 51*a*2, and 51*b*1 of the trailing end fence 51 as illustrated in (a) of FIG. 6. This is because a mechanical error including mounting precision of the trailing end fences 51*a* and 51*b* is considered, and the sheet can be supported more stably, since the sheet is supported on two points.

After the completion of the alignment process, the binding process is carried out by the end-face binding stapler S1. As apparent from the perspective view in FIG. 4 illustrating the operation of the ejection belt, the ejection belt 52 is driven in a counterclockwise direction by an ejection belt drive motor 157. The sheet bundle after the binding process is scooped by the ejection claw 52*a* mounted to the ejection belt 52, and ejected from the end-face binding process tray F. A front plate 64*a* and a rear plate 64*b* are provided. This operation can be possible even for a sheet bundle that is not bounded because the binding process is not executed after the alignment process.

Figure 3:
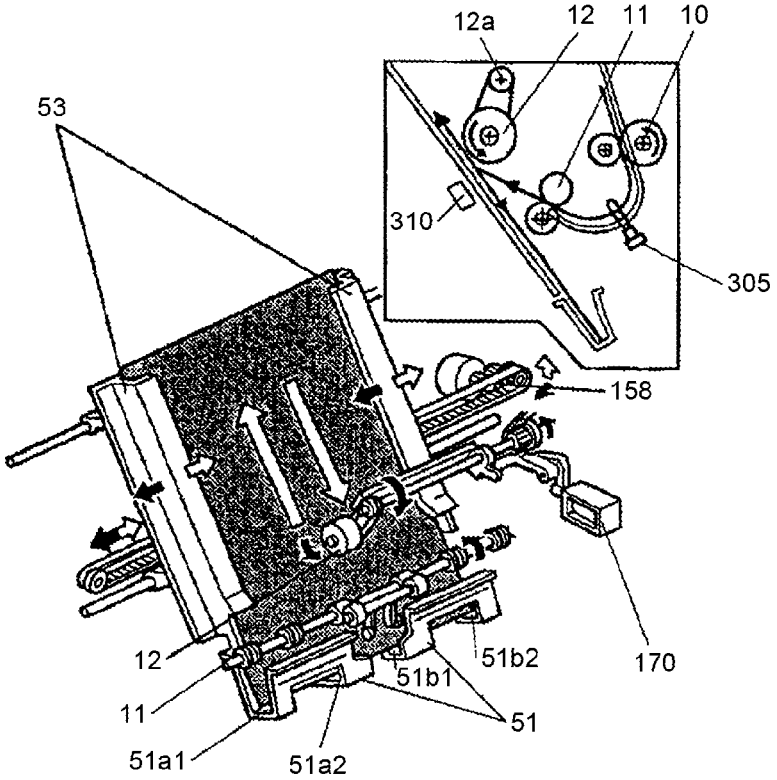
FIG. 3 is a perspective view illustrating a schematic configuration of the end-face binding process tray and its attached mechanism.

FIG. 3 is a perspective view illustrating a schematic configuration of the end-face binding process tray F and its attached mechanism. As illustrated in FIG. 3, the sheet guided to the end-face binding process tray F by the staple discharging roller 11 is stacked one by one on the end-face binding process tray F. When the number of sheet discharged onto the end-face binding process tray F is one, each sheet is aligned in the vertical direction (sheet conveying direction) by the hammer roller 12, and in the widthwise direction (the sheet widthwise direction orthogonal to the sheet conveying direction) by the jogger fences 53*a* and 53*b*. The hammer roller 12 receives a pendulum motion about a fulcrum 12*a* by a hammer SOL 170. The hammer roller 12 intermittently acts on the sheet sent to the end-face binding process tray F to allow the trailing end ST of the sheet to abut against the reference fence 51. The hammer roller 12 rotates in the counterclockwise direction. As illustrated in FIGS. 2 and 3, the jogger fence 53 includes a pair of front and rear jogger fences (53*a*, 53*b*). The jogger fence 53 is driven by a jogger motor 158, which can rotate forward and backward, via a timing belt to reciprocate in the sheet widthwise direction.

Figure 5:
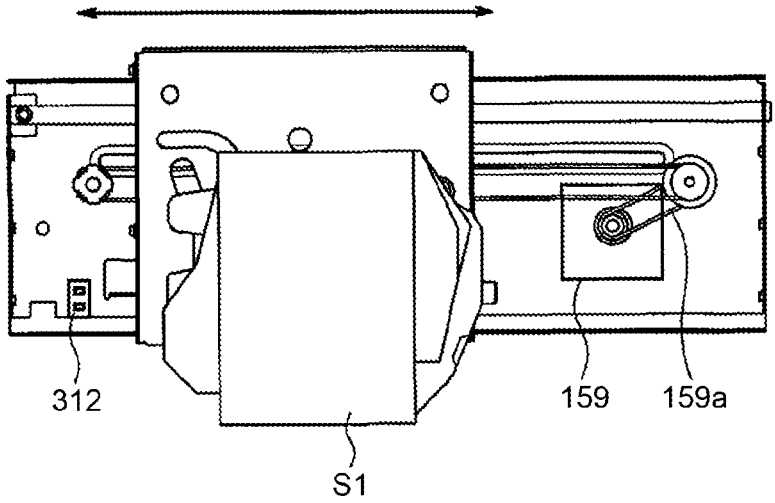
FIG. 5 is a side view illustrating a moving mechanism for an end-face binding stapler in a widthwise direction.

FIG. 5 is a side view illustrating a stapler moving mechanism. As illustrated in FIG. 5, the end-face binding stapler S1 is driven by a stapler moving motor 159, which can rotate forward and backward, via a timing belt 159*a*, so that it moves in the sheet widthwise direction for binding a predetermined position on the trailing end of the sheet. A stapler moving HP sensor 312 that detects a home position of the end-face binding stapler S1 is provided on one end in the moving range of the stapler S1. The binding position in the sheet widthwise direction is controlled by a moving amount of the end-face binding stapler S1 from the home position. The end-face binding stapler S1 is configured to staple the sheet on one point or plural points (in general, two points) on the trailing end of the sheet. The end-face binding stapler S1 can move at least all over the width of the trailing end ST of the sheet supported by the reference fences 51*a* and 51*b*. The end-face binding stapler S1 can be moved maximally toward the front of the apparatus for the exchange of the staples. With this structure, a user can easily exchange the staples.

As illustrated in FIG. 1, a sheet bundle deflecting mechanism I is provided at the downstream side of the end-face binding process tray F in the sheet conveying direction. The sheet bundle deflecting mechanism I greatly changes the direction of the sheet bundle and conveys the sheet bundle from the end-face binding process tray F to the saddle-stitching process tray G. The sheet bundle deflecting mechanism includes some conveying paths for sending the sheet bundle SB from the end-face binding process tray F to the shift tray 202. The sheet bundle SB is conveyed by a conveying mechanism 35 that applies conveying force to the sheet bundle, an ejection roller 56 that turns the sheet bundle, and a guide member 44 that guides the sheet bundle for turn. According to the mechanism involved with the conveyance of the sheet bundle, the sheet bundle SB is conveyed to the saddle-stitching process tray G or the shift tray 202.

The detailed configuration of each component will be described. Driving force of the driving shaft 37 is transmitted to a roller 36 of the conveying mechanism 35 via a timing belt. The roller 36 and the driving shaft 37 are coupled and supported by an arm, whereby the conveying mechanism can swing with the driving shaft 37 serving as a rotation fulcrum. The roller 36 of the conveying mechanism 35 is driven to swing by a cam 40. The cam 40 rotates about a rotating shaft, and is driven by a motor not illustrated. A driven roller 42 is arranged at the position opposite to the roller 36 in the conveying mechanism 35. The driven roller 42 and the roller 36 nip the sheet bundle, and apply pressure by an elastic member to exert conveying force.

A conveying path for turning the sheet bundle from the end-face binding process tray F to the saddle-stitching process tray G is formed between the ejection roller 56 and an inner surface of the guide member 44 opposite to the ejection roller 56. The guide member 44 pivots about a fulcrum, and its drive is transmitted from a bundle bifurcating drive motor 161 (see FIG. 2). When the sheet bundle is conveyed from the end-face binding process tray F to the shift tray 202, the guide member 44 pivots in the clockwise direction about the fulcrum in the figure, so that the space between the outer surface (the surface not opposite to the ejection roller 56) of the guide member 44 and its outer guide plate serves as a conveying path.

When the sheet bundle SB is conveyed from the end-face binding process tray F to the saddle-stitching process tray G, the trailing end of the sheet bundle SB aligned on the end-face binding process tray F is pushed up by the ejection claw 52*a*, and then, the sheet bundle is nipped between the roller 36 of the conveying mechanism 35 and the driven roller 42 opposite to the roller 36, whereby conveying force is applied to the sheet bundle. In this case, the roller 36 of the conveying mechanism 35 waits on a position not in contact with the leading end of the sheet bundle SB. Then, the roller 36 of the conveying mechanism 35 is brought into contact with the surface of the sheet after the leading end of the sheet bundle SB passes, so as to apply conveying force. In this case, the guide member 44 and the ejection roller 56 form a turn conveying path, by which the sheet bundle SB is conveyed to the saddle-stitching process tray G at the downstream side.

As illustrated in FIG. 1, the saddle-stitching process tray G is provided almost perpendicularly at the downstream side of the sheet bundle deflecting mechanism I, and includes a center-folding mechanism arranged on its center, a bundle conveying guide plate top 92 arranged on its upper part, and a bundle conveying guide plate bottom 91 arranged on its lower part.

A bundle conveying roller top 71 is mounted at the upper part of the bundle conveying guide plate top 92, while a bundle conveying roller bottom 72 is mounted at its lower part. A saddle-stitching upper jogger fence 250*a* is arranged on both sides along the side face of the bundle conveying guide plate top 92 so as to cross both rollers 71 and 72. Similarly, a saddle-stitching lower jogger fence 250*b* is mounted on both sides along the side face of the bundle conveying guide plate bottom 91. A saddle-stitching stapler S2 is arranged on the portion where the saddle-stitching lower jogger fence 250*b* is mounted. The saddle-stitching upper jogger fence 250*a* and the saddle-stitching lower jogger fence 250*b* are driven by a drive mechanism, not illustrated, to perform the alignment process in the direction (the sheet widthwise direction) orthogonal to the sheet conveying direction. The saddle-stitching stapler S2 includes paired clincher unit and driver unit, and two pairs are provided with a predetermined space in the sheet widthwise direction.

A movable reference fence 73 is arranged to cross the bundle conveying guide plate bottom 91, and it can move in the sheet conveying direction (in the vertical direction in FIG. 1) by a moving mechanism provided with a timing belt and its driving mechanism. As illustrated in FIG. 1, the driving mechanism includes a drive pulley and a driven pulley, around which the timing belt is looped, and a stepping motor that drives the drive pulley. Similarly, a trailing end hammer claw 251 and its driving mechanism are mounted on an upper end of the bundle conveying guide plate top 92. The trailing end hammer claw 251 can reciprocate in a direction apart from the sheet bundle deflecting mechanism I and a direction of pushing the trailing end (the side corresponding to the trailing end when the sheet bundle is introduced) of the sheet bundle SB by the timing belt 252 and the driving mechanism not illustrated.

The center-folding mechanism is provided almost on the center of the saddle-stitching process tray G, and includes a folding plate 74, a pair of folding rollers 81, and the conveying path H that conveys the folded sheet bundle. FIG. 1 also illustrates a home position sensor 326 that detects a home position of the trailing end hammer claw 251, a folded portion passage sensor 323 that detects the center-folded sheet, a bundle detection sensor 321 detecting that the sheet bundle reaches the center-folded position, and a movable reference fence home position sensor 322 that detects the home position of the movable reference fence 73.

In the present embodiment, a detection lever 501 that detects a height of the stack of the center-folded sheet bundle is mounted on the lower tray 203 so as to be capable of swinging about a fulcrum 501*a*. A sheet surface detection sensor 505 detects an angle of the detection lever 501, and a later-described CPU 401 controls the upward and downward movement of the lower tray 203 based upon the detected angle for detecting overflow.

Figure 7:
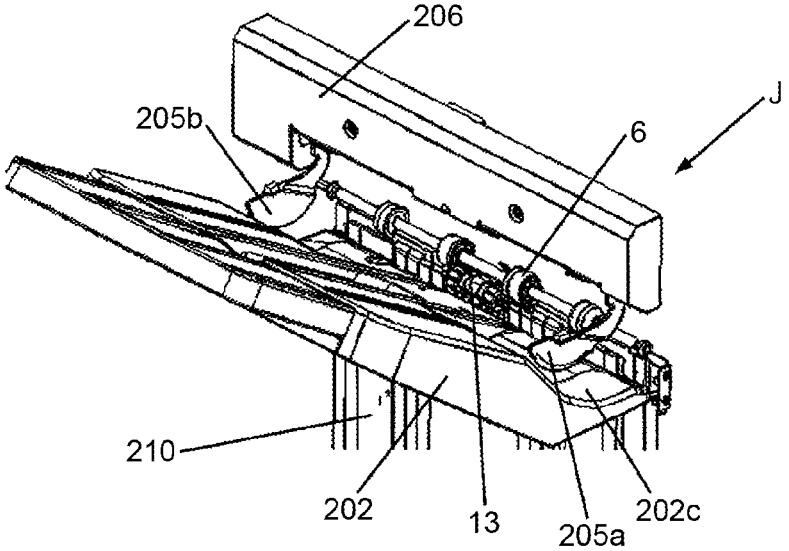
FIG. 7 is a perspective view illustrating a schematic configuration of a discharging portion.

FIG. 7 is a perspective view illustrating a schematic configuration of a discharging portion J serving as the sheet discharging device. As apparent from FIG. 7, a pair of joggers 205*a* and 205*b* that aligns a sheet P in the widthwise direction on the shift tray 202 is provided above the shift tray 202. The joggers 205*a* and 205*b* can move in the sheet widthwise direction by a jogger driving mechanism 206. The jogger driving mechanism 206 has a known structure, and the driving mechanism is not directly involved with the present invention, so that it will not be described in detail. FIG. 7 also illustrates an escaping portion (recess portion) 202*c* that permits the movement of the joggers 205*a* and 205*b*. The returning roller 13 is provided on a sheet discharging port of the shift tray 202, and it brings the trailing end of the returned sheet P to be in contact with the end fence 210. The end fence 210 serves as a guide to move the shift tray 202 in the perpendicular direction. The joggers 205*a* and 205*b* are provided slightly downstream from the sheet discharging port.

Figure 8:
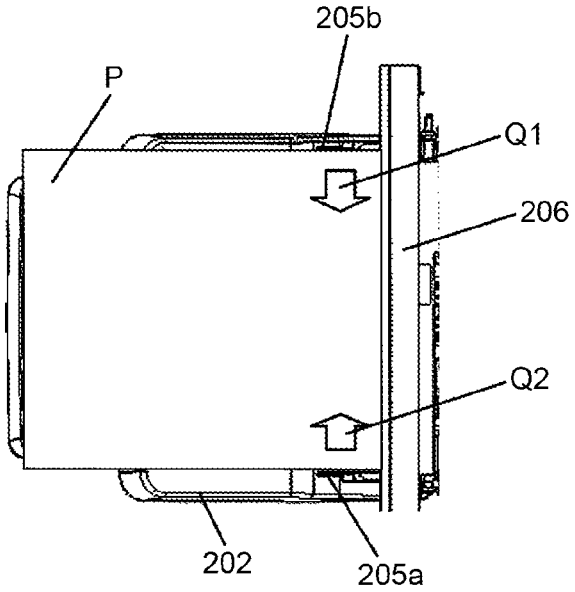
FIG. 8 is a plan view of FIG. 7.

The sheet discharged from the image forming apparatus PR is discharged onto the shift tray 202 from the discharging portion J, and stacked onto the shift tray 202. In order to prevent the sheet from being stacked in a random fashion, after the sheet is discharged, the returning roller 13 rotates to be in contact with the sheet for returning the sheet in the direction of the end fence 210, and brings the trailing end of the sheet to be in contact with the end fence 210 to align the sheet in the sheet conveying direction. As illustrated in FIG. 8 that is a plan view of FIG. 7, the joggers 205*a* and 205*b* move toward the center of the sheet (toward the center in the longitudinal direction) from both sides in the widthwise direction in arrows Q1 and Q2 in FIG. 8, thereby aligning the sheet in the widthwise direction.

Figure 9:
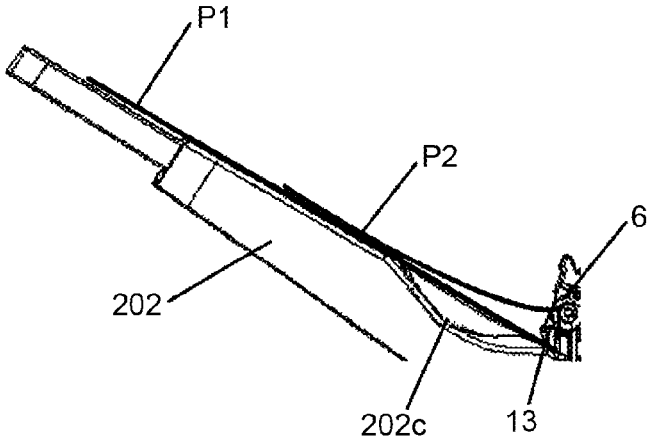
FIG. 9 is a front view of the shift tray illustrating a discharging trouble.
Figure 10:
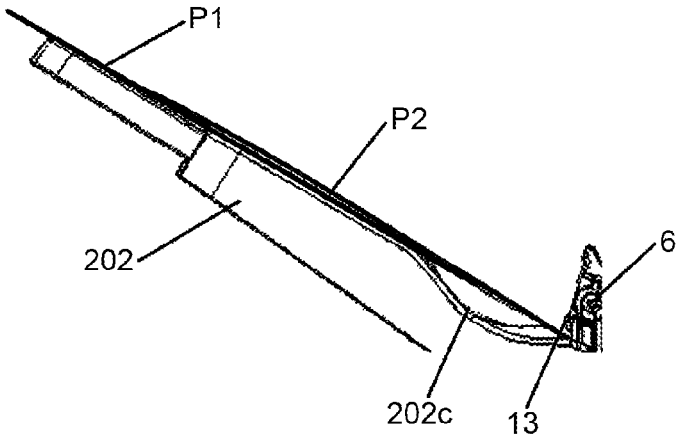
FIG. 10 is a front view of the shift tray illustrating a stacking trouble (push-out)
Figure 11:
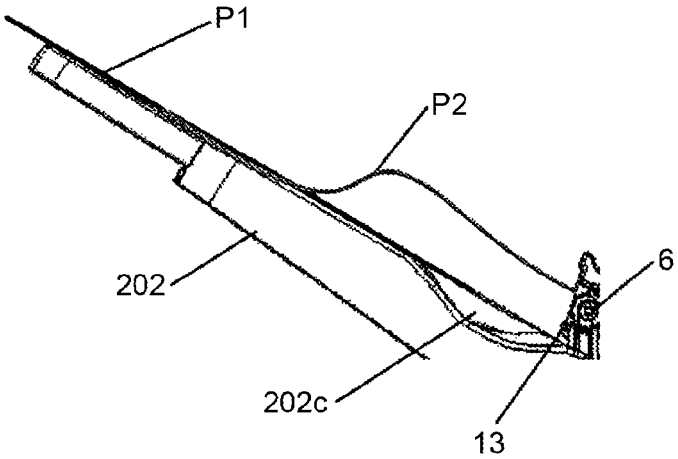
FIG. 11 is a front view of the shift tray illustrating a stacking trouble (warp)

However, the discharge tray having the configuration described above has the problem described above, when a sheet P having high smoothness, such as a coat paper, is stacked. For example, when a following sheet P2 is discharged with a preceding sheet P1 being stacked onto the shift tray 202 as illustrated in FIG. 9, the sheets are adhered to each other due to adhesion force between the sheets. When the sheets are adhered, the following sheet P2 might push the preceding sheet P1 as being in contact with the preceding sheet P1 as illustrated in FIG. 10. Alternatively, the following sheet P2 is not conveyed any more with its leading end being in intimate contact with the preceding sheet, so that the following sheet might be warped (buckled) as illustrated in FIG. 11. A discharge trouble or stacking trouble is caused even by either one of the cases described above.

Figure 12:
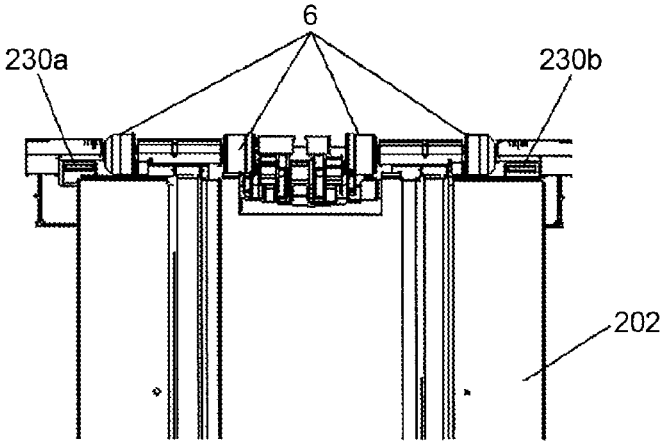
FIG. 12 is a plan view illustrating the discharging portion provided with a blowing device.
Figure 13:
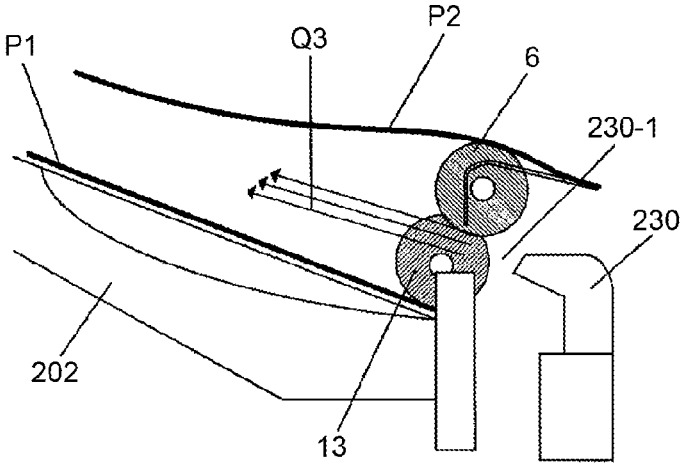
FIG. 13 is a front view of FIG. 12 when a sheet is discharged.

In the present embodiment, a blowing device is provided in order to prevent the discharge trouble and stacking trouble described above. FIG. 12 is a plan view illustrating the configuration of the discharging portion J provided with the blowing device, and FIG. 13 is a front view illustrating the state when the sheet is discharged in FIG. 12. First and second blowing devices 230*a* and 230*b* (the blowing device at the far side of the apparatus is 230*a*, and the blowing device at the near side is 230*b*. When both are not distinguished, the blowing device is described as 230) are located below the discharging roller 6 as illustrated in FIGS. 12 and 13. When the sheet is discharged from the discharging portion J, the first and second blowing devices 230*a* and 230*b* send air.

Air is sent between the upper surface of the stacked sheet (preceding sheet P1) and the lower surface of the discharged sheet (following sheet P2) (in the case of the first sheet, between the stacking surface of the shift tray 202 and the lower surface of the discharged sheet P2) as illustrated in FIG. 13. Air is sent in a direction of Q3 illustrated in FIG. 13, so that air flows between the stacked surface (preceding sheet P1) and the discharged sheet (following sheet P2). Therefore, the contact between both sheets P1 and P2 can be prevented. As a result, the discharge trouble (buckling) and stacking trouble (push-out) caused by the adsorption can be prevented.

In the present embodiment, the first blowing device 230*a* is provided at the far side of the device, and the second blowing device 230*b* is provided at the near side of the device, and air is sent to the lower surface of the discharged sheet P2 from two portions on both ends in the widthwise direction of the discharged sheet P2 (the direction orthogonal to the sheet conveying direction). In this case, if air is blown toward the inside from the first and second blowing devices 230*a* and 230*b*, even a small-sized sheet can enjoy the effect of the blowing devices.

In the example in FIG. 13, a blowing portion 230-1 of the blowing device 230 is always opened as viewed from the outside of the device. When the blowing portion 230-1 is always opened as described above, some objects might be inserted into the blowing device 230 from the blowing portion 230-1, or foreign matter such as dust might enter the blowing device 230. When an object is inserted, the blowing device 230 might be damaged.

When an air volume during the blowing is equal to all types of sheets (type of sheet, sheet size, thickness of sheet), the air volume is insufficient depending upon the type of the sheet, so that the effect of preventing the discharge trouble or stacking trouble might not be realized. There may be the case in which the sheet is blown by excessive air volume. When air is sent even after the discharged sheet (following sheet) P2 completely passes through the nip of the discharging roller 6, the discharged sheet (following sheet) P2 is carried by airflow when falling onto the shift tray 202, so that the falling position becomes unstable. When the falling position becomes unstable, the stacked position becomes non-uniform, which causes stacking trouble.

Figure 14:
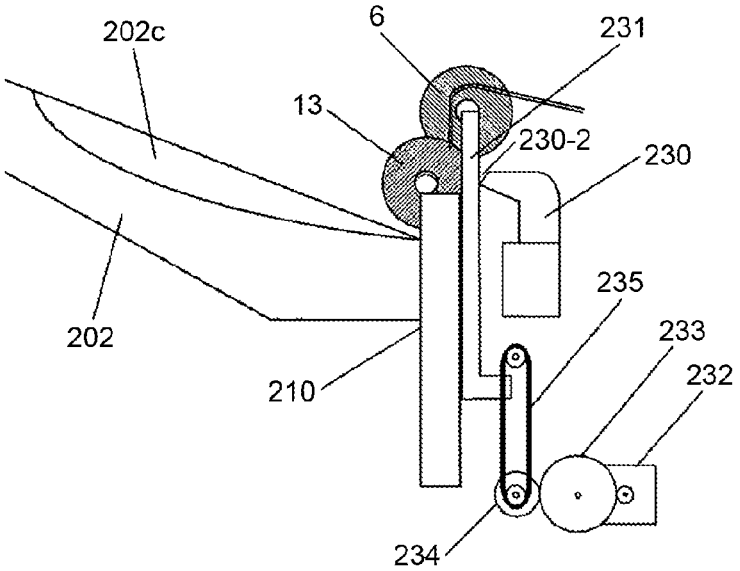
FIG. 14 is a front view illustrating a relevant portion of the discharging portion.

In view of this, in the present embodiment, a blocking member 231 for closing the blowing portion 230-1 of the sheet post-processing apparatus PD is provided as illustrated in FIG. 14 that is a front view of a relevant portion of the discharging portion J. The blocking member 231 is provided on a position where air sent from a blowing port 230-2 of the blowing device 230 is blocked at an outlet from the blowing portion 230-1. Specifically, the blocking member 231 is mounted to the end fence 210 at the inside of the device, and it can ascend and descend through a gear 233, a gear 234, and a timing belt 235 by the drive of a motor 232. The amount of opening of the blowing portion 230-1 can be controlled to be variable by the configuration in which the blocking member 231 can ascend and descend with the operation of the timing belt 235. The air volume can be adjusted by this variable control.

During the stand-by state of the sheet discharging portion in which the sheet is not discharged from the sheet discharging portion J, the blocking member 231 is located on an ascending position where the blocking member closes the blowing port 230-2 as illustrated in FIG. 14. With this structure, the blowing portion 230-1 is closed during the stand-by state, so that some objects such as dust can be prevented from entering from the blowing portion 230-1. If the intrusion of the object such as dust can be prevented, the damage of the blowing device 230 can also be prevented. The blocking member 231 is not limited to the shape illustrated in FIG. 14. The blocking member 231 may only have a shape by which the blowing portion 230-1 at the downstream side of the blowing port 230-2 can be functionally closed.

Figure 15:
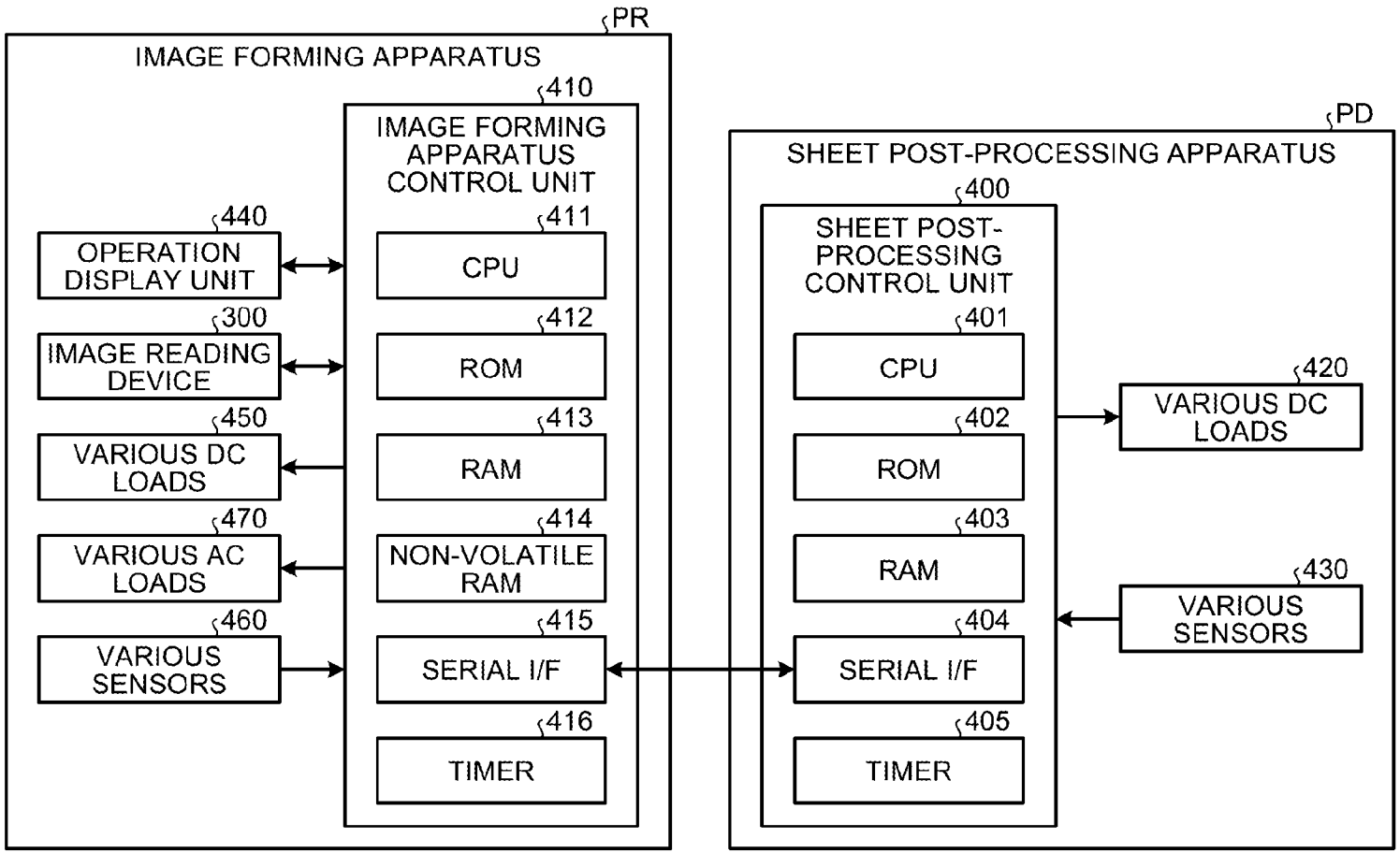
FIG. 15 is a block diagram illustrating a control configuration of an image forming system according to the embodiment of the present invention.

FIG. 15 is a block diagram illustrating a control configuration of the image forming system according to the present embodiment.

In FIG. 15, the control of the image forming apparatus PR is executed by an image forming apparatus control unit 410 that has incorporated therein a CPU 411, a ROM 412, a RAM 413, a non-volatile RAM 414, a serial interface (hereinafter referred to as serial I/F) 415, a timer 416, and the like. The control of the sheet post-processing apparatus PD is executed by a sheet post-processing apparatus control unit 400 having incorporated therein a CPU 401, a ROM 402, a RAM 403, a serial I/F 404, a timer 405, and the like. The image forming apparatus control unit 410 and the sheet post-processing apparatus control unit 400 send and receive commands necessary for a sheet stacking control via the serial I/F 415 and 404, respectively.

A program code for the control of the image forming apparatus PR is stored in the ROM 412. The CPU 411 reads the program code from the ROM 412, and develops the same on the RAM 413. The CPU 411 stores the data necessary for the control onto the RAM 413, and executes the program defined by the program code as using the RAM 413 as a work area, thereby controlling the respective units. A motor used for an image forming unit such as a photosensitive element, various DC loads 450 and various AC loads 470 such as various motors or clutches in the paper feeding unit, a paper conveying path, a duplex conveying path and the like, and various sensors 460 such as a temperature sensor for detecting the temperature of the fixing roller are connected to the image forming apparatus control unit 410. An image reading device 300 and an operation display unit 440 are also connected to control the respective units via the image forming apparatus control unit 410.

The control of the sheet post-processing apparatus PD is executed by the sheet post-processing apparatus control unit 400 as described above. A program code for the control is stored in the ROM 402. The CPU 401 reads the program code from the ROM 402, develops the same on the RAM 403, and stores the data necessary for the control onto the RAM 403. The CPU 401 then executes the control defined by the program code, as using the RAM 403 as a work area, thereby controlling various DC loads 420. The DC loads 420 include, for example, a discharging motor that drives the discharging roller 6, a returning motor that drives the returning roller 13, a motor 232 that drives to move the blocking member 231 up and down, a blowing motor that drives a blowing fan of the blowing device 230, and a lifting and lowering motor that lifts and lowers the shift tray 202.

The image forming apparatus PR and the sheet post-processing apparatus PD send and receive commands necessary for the post-processing control via the serial I/F 415 and 404 as described above. The CPU 401 of the sheet post-processing apparatus PD executes various controls including the ascending and descending control of the discharging roller 6, the returning roller 13, and the blocking member 231, the control (ascending and descending control) of the position of the height of the shift tray 202, the drive control of the blowing motor, and a control procedure illustrated in respective flowcharts described later, from the command and sheet position information acquired from various sensors 430 including a later-described sensor Se1.

Figure 16:
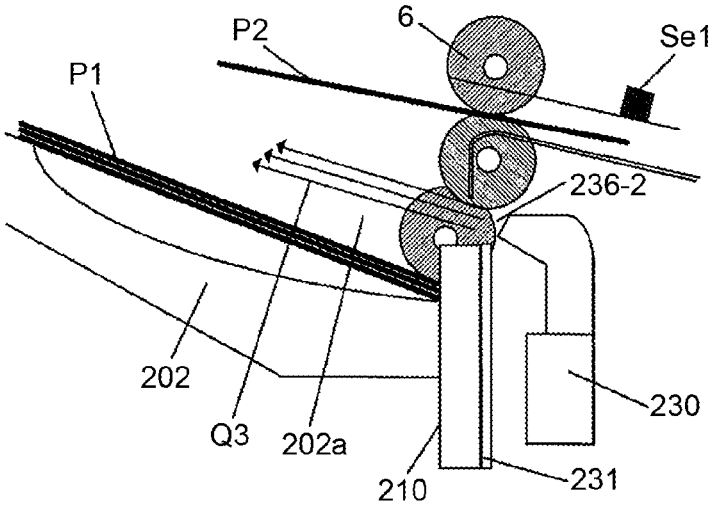
FIG. 16 is an explanatory view illustrating a closing operation of a blocking member on the discharging portion.

FIG. 16 is an explanatory view illustrating a closing operation of the blocking member 231. In FIG. 16, the sheet detection sensor Se1 is arranged at the upstream side of the discharging roller 6, whereby the leading end and the trailing end of the sheet can be detected.

Figure 17:
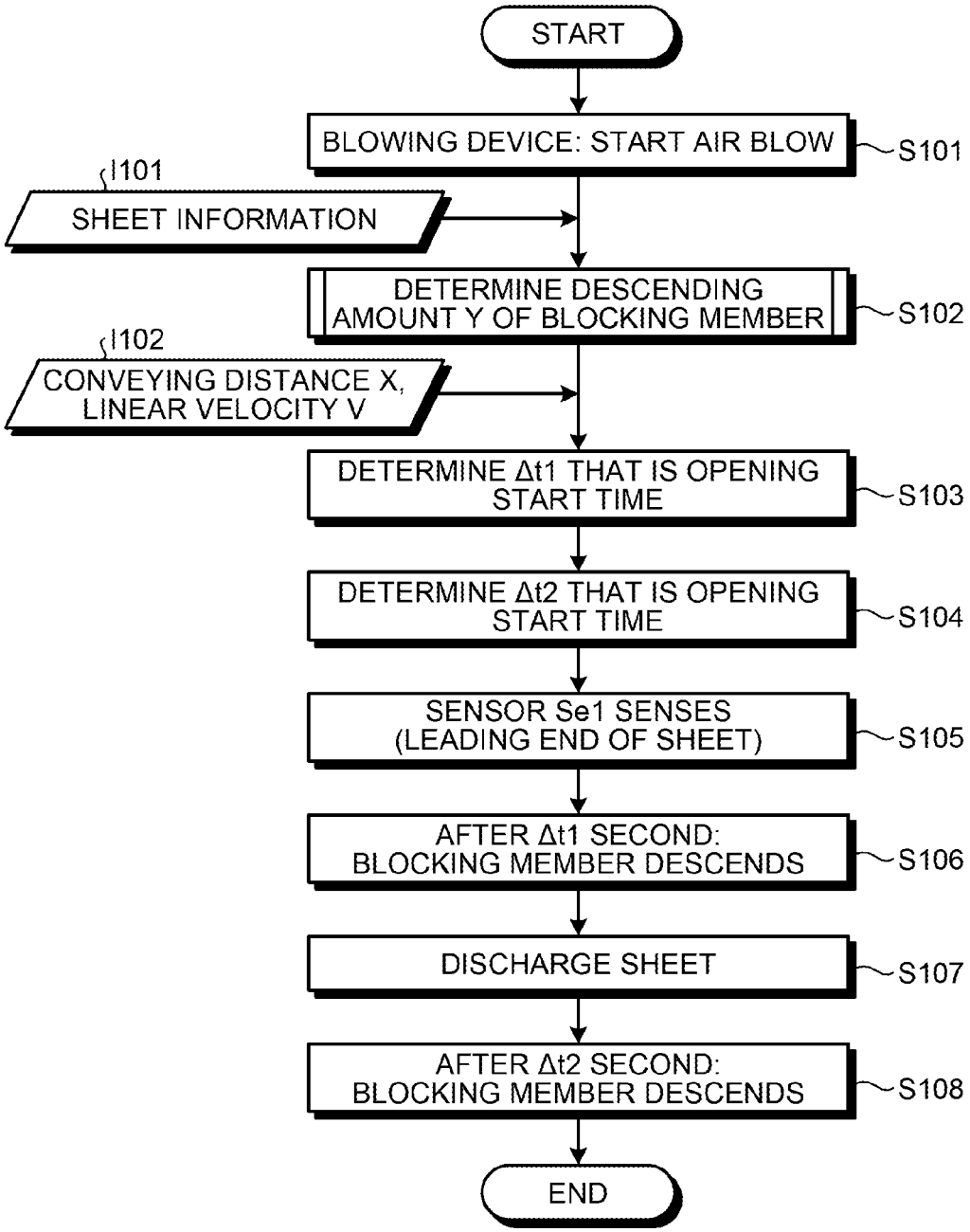
FIG. 17 is a flowchart illustrating a procedure of an operation of lifting and lowering the blocking member.

FIG. 17 is a flowchart illustrating the procedure of the ascending and descending operation of the blocking member. As illustrated in FIG. 17, the blowing device 230 starts to send air after the sheet P2 is discharged from the image forming apparatus PR (step S101). In this case, the air blow to the stacking portion (upper surface of the shift tray 202) 202*a* is blocked by the blocking member 231. When the leading end of the sheet P2 to be discharged is detected by the sheet detection sensor Se1 (step S105), the blocking member 231 descends after a time (after Δt1 second) set beforehand with the detection timing being used as a trigger (step S106). Then, the blowing portion 230-1 is opened to send air to the stacking portion 202*a*. When the sheet P2 is discharged onto the shift tray 202 (step S107), and after Δt2 second (Δt1<Δt2) from the detection timing, the blocking member 231 is lifted to again close the blowing portion 230-1 (step S108).

After the blowing device 230 starts to send air (step S101), the sheet post-processing apparatus PD receives sheet information (type of sheet, sheet size, thickness of sheet: I101) from the image forming apparatus PR, and then, the CPU 401 determines a descending amount Y mm (opening amount) of the blocking member of the blowing portion 230-1 based upon the sheet information (step S102). The sheet post-processing apparatus PD also receives information (I102) about the conveying distance X mm to the nip of the discharging roller 6 and a linear velocity V mm/s from the sheet detection sensor Se1, and determines an opening start time Δt1 and an opening time Δt2 of the blowing portion 230-1 (steps S103, S104). The procedure of determining the descending amount of the blocking member in step S102 is illustrated in FIG. 18.

Figure 18:
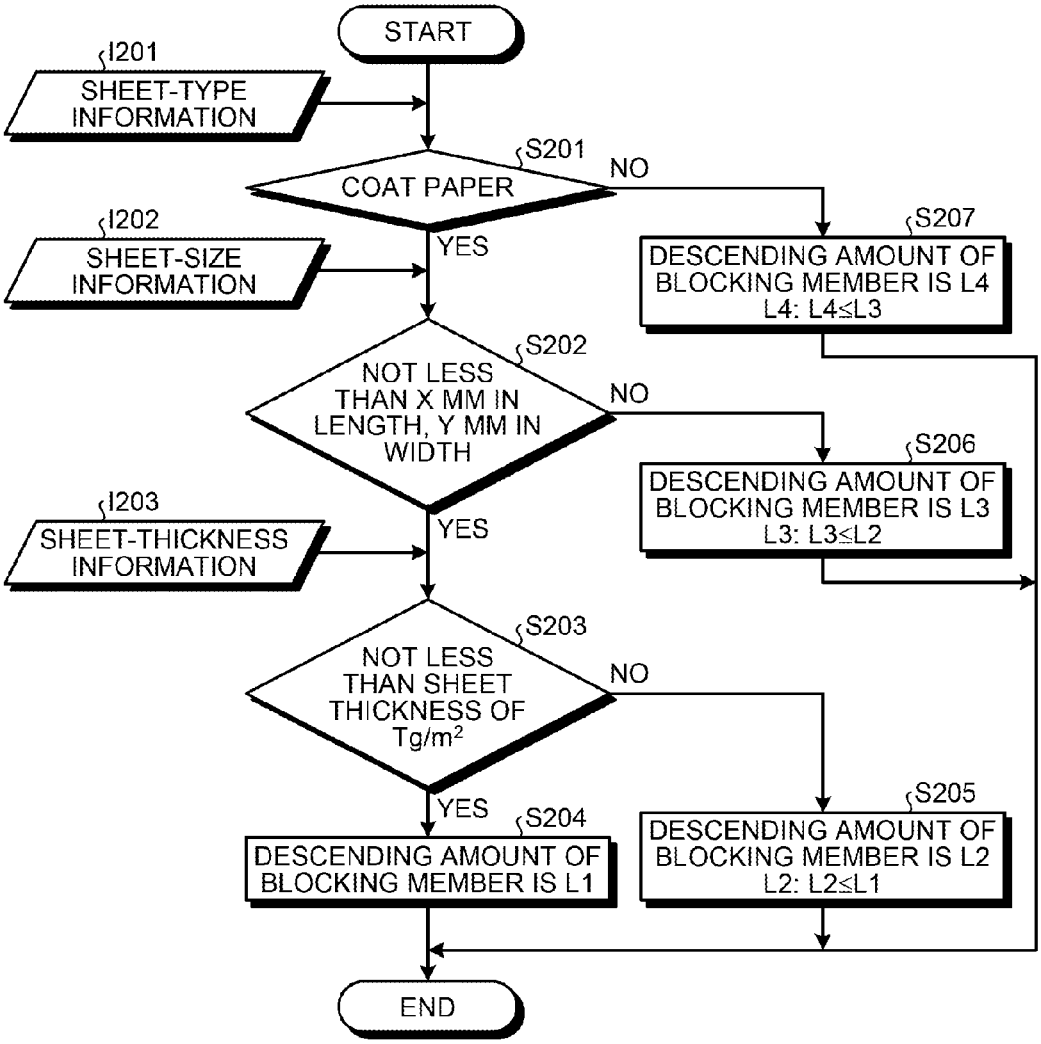
FIG. 18 is a flowchart illustrating a procedure of determining a descending amount of the blocking member.

FIG. 18 is a flowchart illustrating the procedure of determining the descending amount of the blocking member. In this procedure, it is determined whether the sheet is a coat paper or not by referring to the sheet information I201 (step S201). When the sheet is a coat paper as a result of the determination in step S201, the CPU 401 determines whether or not the sheet size is equal to or larger than X mm in length×Y mm in width (step S202) by referring to the sheet-size information I202. When the sheet size is equal to or larger than X mm in length×Y mm in width, the CPU 401 refers to the sheet-thickness information I203 so as to determine whether or not the thickness of the sheet is equal to or larger than T g/m$^2$ set beforehand (step S203).

When the thickness of the sheet is equal to or larger than T g/m$^2$ as a result of the determination in step S203, the descending amount of the blocking member 231 is set as a descending amount L1 set beforehand (step S204). When the thickness of the sheet is less than T g/m$^2$ as a result of the determination in step S203, the descending amount of the blocking member 231 is set as L2 that is not more than L1 (step S205). When the sheet size is smaller than the size of X mm in length and Y mm in width as a result of the determination in step S202, the descending amount of the blocking member 231 is set as L3 that is not more than L2 (step S206). When the sheet is determined not to be the coat paper in the determination in step S201, the descending amount of the blocking member 231 is set as L4 not more than L3 (step S207).

As understood from this procedure, the descending amount of the blocking member is set as L1 when the sheet is the coat paper, the sheet size is equal to or larger than the size of X mm in length and Y mm in width, and the thickness of the sheet is equal to or larger than T g/m$^2$ in the present embodiment. When the sheet is the coat paper, the sheet size is equal to or larger than the size of X mm in length and Y mm in width, and the thickness of the sheet is smaller than T g/m$^2$, the descending amount L2 of the blocking member is set to be not more than the descending amount L1. When the sheet is the coat paper, and the sheet size is smaller than the size of X mm in length and Y mm in width, the descending amount L3 of the blocking member is set to be not more than the descending amount L2. When the sheet is not the coat paper, the descending amount L4 of the blocking member is set to be not more than the descending amount L3.

The sheet size of X mm in length and Y mm in width, and the thickness of the sheet T g/m$^2$, which are the threshold values, and the descending amounts L1, L2, L3, and L4 are experimentally obtained, and stored in the ROM 402 in the form of a table. The CPU 401 takes these values into the RAM 403 when using, and refers to according to need. The descending amount Y mm of the blocking member can manually be adjusted by a user or a service man from the operation display unit 440 of the image forming apparatus PR.

When the air volume cannot be adjusted, the sheet might be blown, if air corresponding to the condition that the sheet is a coat paper having the size equal to or larger than X mm in length and Y mm in width, and having the thickness equal to or larger than T g/m$^2$ is sent to the sheet satisfying the condition that the sheet is a coat paper having a size less than X mm in length and Y mm in width, due to excessive air volume. Further, even if air corresponding to the condition that the sheet is a coat paper having a size less than X mm in length and Y mm in width is sent to the sheet satisfying the condition that the sheet is a coat paper having a size equal to or larger than X mm in length and Y mm in width, and having a thickness equal to or larger than T g/m$^2$, the effect of preventing the adhesion cannot be obtained due to insufficient air volume. However, as in the present embodiment, the insufficient air volume and excessive air volume can be prevented by adjusting the air volume through the control of the descending amount of the blocking member 231 based upon the sheet information I101 including the sheet-type information I201, the sheet-size information I202, and the sheet-thickness information I203. This structure can prevent the discharge trouble and stacking trouble, which are caused by the insufficient air volume, and the blow of the sheet caused by the excessive air volume.

Since the blowing portion 230-1 is opened Δt1 second after the detection of the leading end of the sheet based upon the sheet detection information acquired from the sheet detection sensor Se1, and the blowing portion 230-1 is closed Δt2 second after the detection of the leading end of the sheet, the blowing portion 230-1 can be opened and closed according to the sheet discharging timing. When the discharged sheet P2 falls onto the shift tray 202, the blowing portion 230-1 is closed, so that air is not sent to the shift tray 202. Therefore, the stacking trouble caused by airflow can be prevented.

Second Embodiment

A second embodiment describes a structure in which a shutter is mounted in a fan duct on both ends of the discharging portion in order to control volume of air emitted from a duct exhaust port.

An image forming apparatus and a sheet post-processing apparatus are the same as the image forming apparatus PR and the sheet post-processing apparatus PD described with reference to FIGS. 1 and 6.

Figure 19:
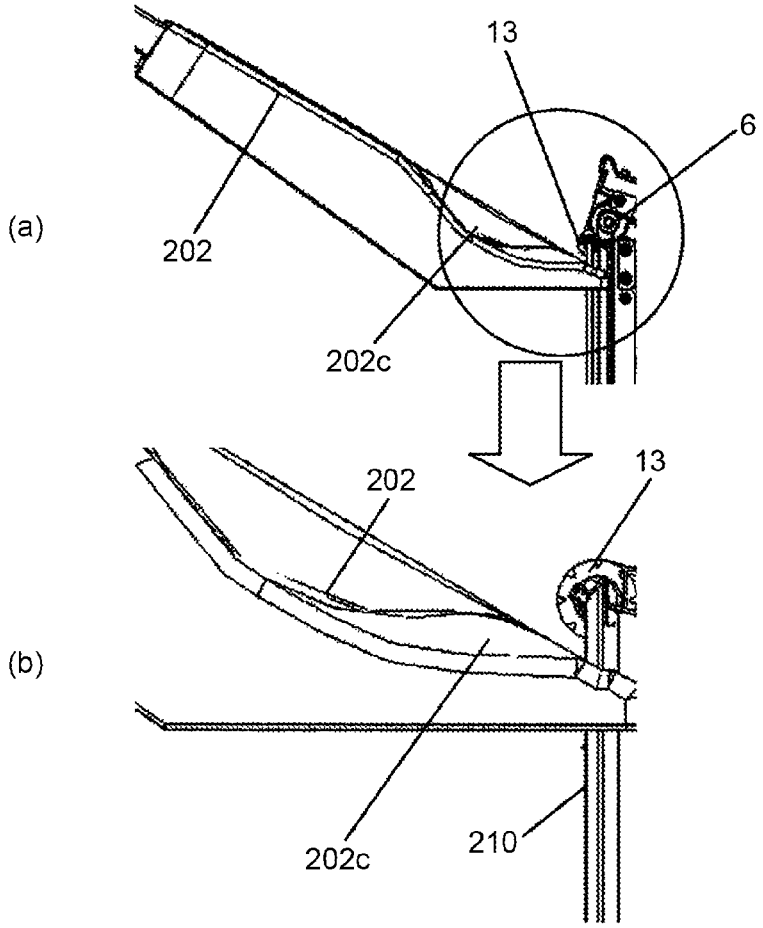
FIG. 19 illustrates a relevant portion of a discharging portion of a shift tray according to a second embodiment of the present invention.

FIG. 19 illustrates a relevant portion of a discharging portion of the shift tray, wherein (a) illustrates a stand-by state during the discharge of the sheet, and (b) is an enlarged view of a relevant portion encircled in (a) of FIG. 19. A sheet P is conveyed to the shift tray 202 via the pair of discharging rollers 6 (6*a*, 6*b*), and sorted on the shift tray 202. The sheet is sorted by using the pair of shift-discharging rollers 6, the returning roller 13, the shift tray 202, the shift mechanism, and the shift tray lifting and lowering mechanism as described above.

Figure 20:
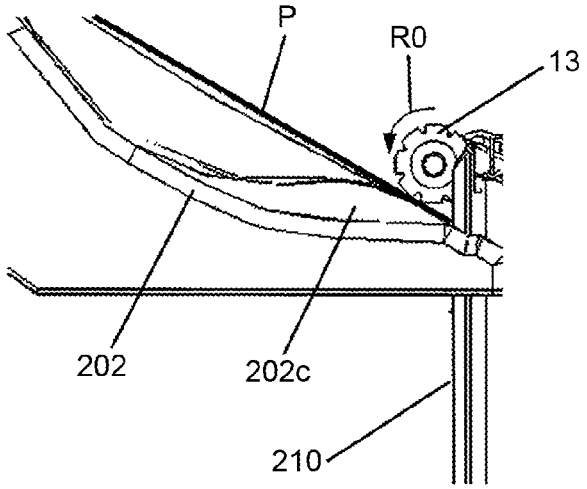
FIG. 20 is an explanatory view illustrating an alignment operation in the conveying direction according to the second embodiment.

FIG. 20 is an explanatory view illustrating an alignment process in the conveying direction. After the sheet is discharged, the returning roller 13 is in contact with the sheet P and rotates in a direction (direction of an arrow R0) of returning the sheet P toward the end fence 210, whereby the sheet P is positively returned to the end fence 210. Thus, the alignment process is executed. The returning roller 13 is driven by a returning roller drive motor not illustrated, and the driving force is transmitted by a timing belt.

However, the discharge tray having the configuration described above has the problem described above, when a sheet P having high smoothness, such as a coat paper, is stacked. When a following sheet P2 is discharged with a preceding sheet P1 being stacked onto the shift tray 202 as illustrated in FIG. 9, the sheets are adhered to each other due to adhesion force between the sheets. When the sheets are adhered, the following sheet P2 might push the preceding sheet P1 as being in contact with the preceding sheet P1 as illustrated in FIG. 10. Alternatively, the following sheet P2 is not conveyed any more with its leading end being in intimate contact with the preceding sheet, so that the following sheet might be warped (buckled) as illustrated in FIG. 11. A discharge trouble or stacking trouble is caused even by either one of the cases described above.

Figure 21:
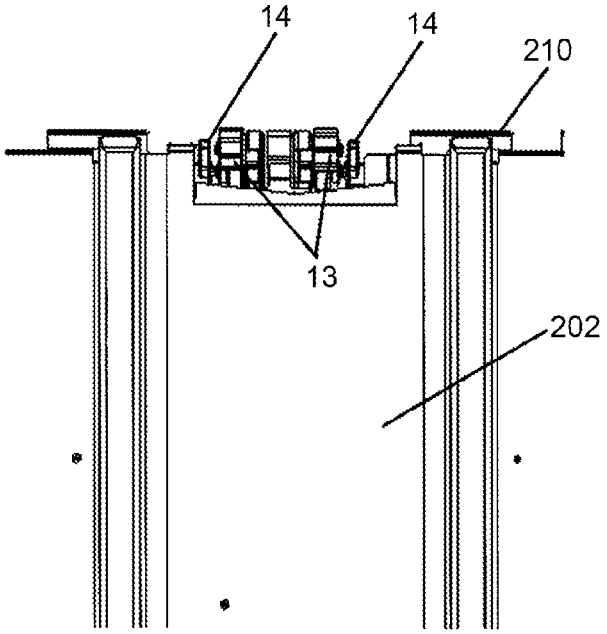
FIG. 21 is a front view illustrating the discharging portion viewed from the shift tray according to the second embodiment.
Figure 22:
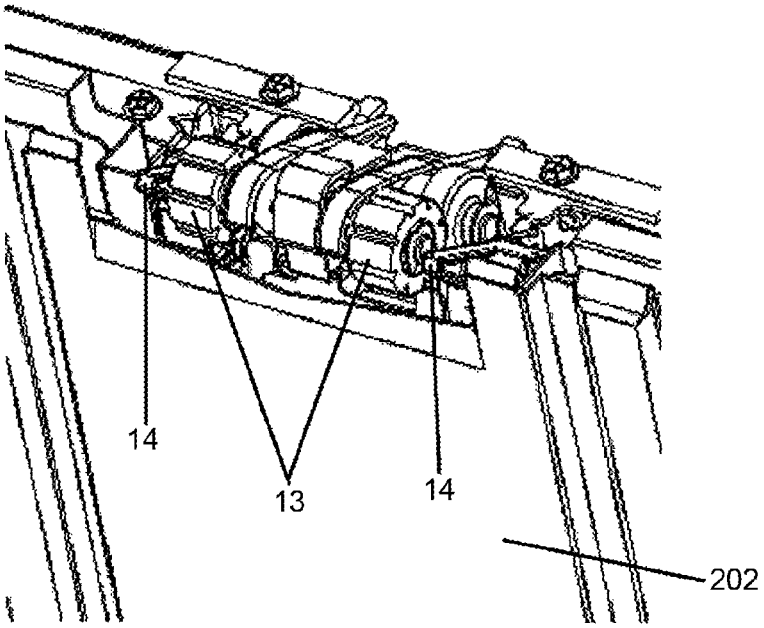
FIG. 22 is a perspective view illustrating the discharging portion in FIG. 21 viewed from obliquely above.

In the present embodiment, the configuration of the discharging portion illustrated in FIGS. 7, 19, and 20 is changed to a configuration illustrated in FIGS. 21 and 22.

FIG. 21 is a view illustrating the discharging portion in the present embodiment viewed from the shift tray, and FIG. 22 is a perspective view illustrating the discharging portion in FIG. 21 viewed from obliquely above.

In FIGS. 21 and 22, a pair of returning rollers 13 is provided symmetric with respect to the center of the shift tray 202 in the conveying direction. Pressing members 14 are provided at the outside of the returning rollers 13 so as to be symmetric with respect to the center. Specifically, a pair of the returning rollers 13 and a pair of pressing members 14 are provided symmetric with respect to the center of the shift tray 202 in the conveying direction.

The pressing member 14 presses the sheet, only when the sheet that is a coat paper passes. Although described later, the CPU 401 of the sheet post-processing apparatus PD determines whether the sheet is a coat paper or not based upon the sheet-type information transmitted from the image forming apparatus PR for controlling the operation.

Figure 23:
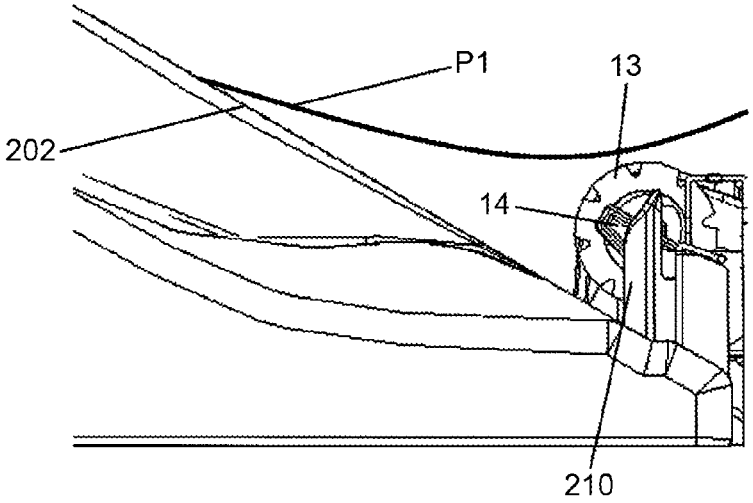
FIG. 23 is an explanatory view of a pressing member, illustrating a state in which a preceding sheet is currently discharged onto the shift tray.
Figure 24:
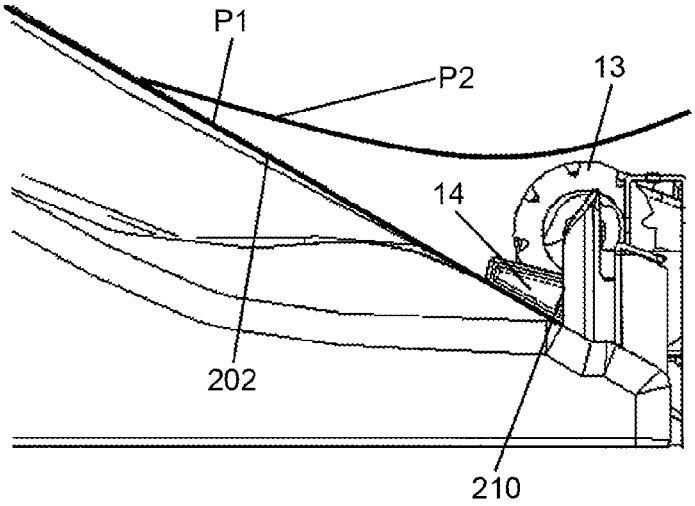
FIG. 24 is an explanatory view of the pressing member, illustrating a state in which the pressing member presses the trailing end of the preceding sheet before a following sheet is brought into contact with the preceding sheet.

FIGS. 23 and 24 are explanatory views illustrating an outline of the operation of the pressing member. FIG. 23 illustrates the state in which the preceding sheet P1 is currently discharged onto the shift tray 202. When the preceding sheet P1 is discharged onto the shift tray 202 with this state, the returning roller 13 descends to return the preceding sheet P1 on the shift tray 202 toward the end fence 210. Thus, the sheet is aligned in the conveying direction. Then, the sheet is aligned in the widthwise direction by the joggers 205*a* and 205*b*.

After the alignment process in the conveying direction and in the widthwise direction is completed, the pressing member 14 presses the trailing end of the preceding sheet P1 before the following sheet P2 is brought into contact with the preceding sheet P1 as illustrated in FIG. 24. After the following sheet P2 is discharged, and the trailing end of the following sheet P2 completely passes through the discharging roller 6, the pressing member 14 is separated from the preceding sheet P1.

Figure 25:
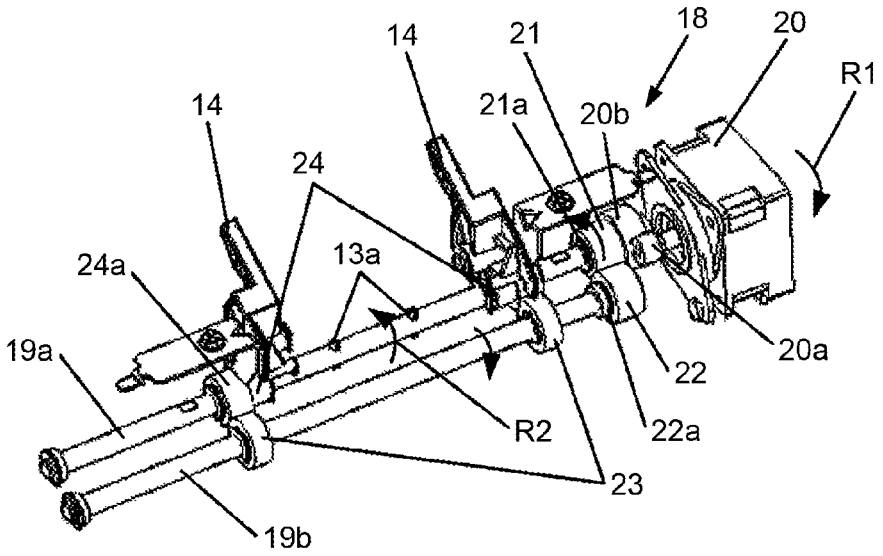
FIG. 25 is a view illustrating states of a driving mechanism of a returning roller and the pressing member during the operation of the returning roller.
Figure 26:
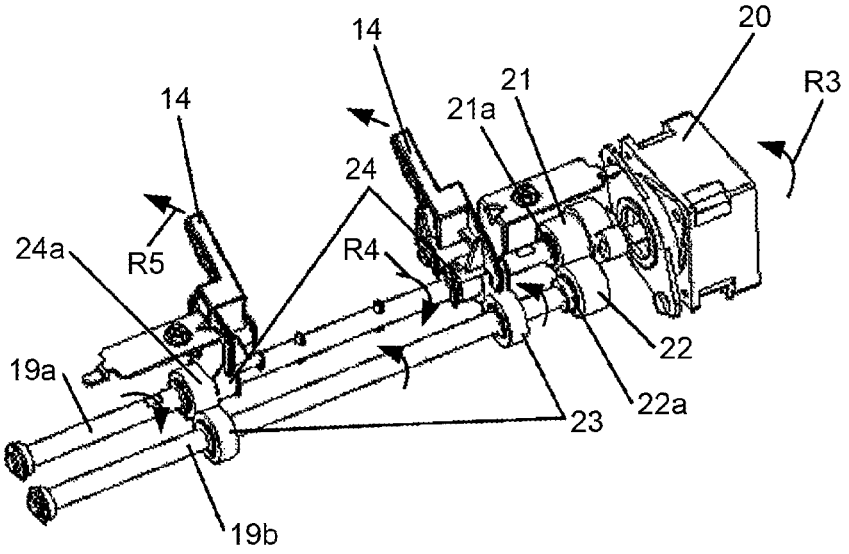
FIG. 26 is a view illustrating states of the driving mechanism of the returning roller and the pressing member during the operation of the pressing member.

FIGS. 25 and 26 are views illustrating a driving mechanism of the returning roller and the pressing member. FIG. 25 illustrates the state in which the returning roller is operated, and FIG. 26 illustrates the state in which the pressing member is operated.

The driving mechanism 18 includes a first shaft 19*a*, a second shaft 19*b*, a returning roller drive motor 20 that rotates the first shaft 19*a*, a drive gear 20*a*, a driven gear 20*b*, first to third gears 21, 22, and 23, and a cam 24.

The returning roller drive motor 20 has the drive gear 20*a* on its leading end of a rotating shaft. The drive gear a is meshed with the driven gear 20*b* mounted to one end of the first shaft 19*a*, so that it can rotate the first shaft 19*a* forward and backward.

The first gear 21 meshed with the second gear 22 that is mounted on one end of the second shaft 19*b* is mounted to the first shaft 19*a*, so that the driving force of the returning roller drive motor 20 can be transmitted to the second shaft 19*b*. One-way clutches 21*a* and 22*a* that lock when the first gear 21 and the second gear 22 rotate in the inverse direction are provided respectively to the first gear 21 and the second gear 22.

A pair of third gears 23 is provided symmetric with respect to the center of the sheet P in the conveying direction, and is fixed to the second shaft 19*b*. With this structure, the third gears 23 rotate together with the rotation of the second shaft 19*b*. The third gears 23 are meshed with gear positions of a pair of cams 24 mounted to the first shaft 19*a* for driving the cams 24. The cams 24 are not fixed to the first shaft 19*a*, so that they rotate only when the third gears 23 rotate. Each of the pair of pressing members 14 is supported to a support shaft 14*d* (see FIGS. 27 and 28) so as to be rotatable. It is operated by each of the pair of cams 24 provided rotatably to the first shaft 19*a* to move (swing) between a pressing position and a retreating position.

In the driving mechanism 18 thus configured, the returning roller drive motor 20 is used as a driving source. In FIGS. 25 and 26, the returning roller 13 is fixed to a projection 13*a* projecting on a circumference portion of the first shaft 19*a*, and rotates in synchronism with the first shaft 19*a*.

FIG. 25 illustrates the state in which the returning roller drive motor 20 rotates forward (in the direction of an arrow R1). When the returning roller drive motor 20 rotates forward, the first and second gears 21 and 22 rotate to rotate the returning roller 13 (the first shaft 19*a*) in the direction of returning the sheet (the direction of an arrow R2). However, due to the one-way clutches 21*a* and 22*a*, the first shaft 19*a* rotates, but the second shaft 19*b* stops, resulting in that the third gear 23 and the cam 24 do not rotate. Thus, the pressing member 14 is held on the retreating (separating) position illustrated in FIG. 23.

When the returning operation of the returning roller 13 is completed, the pressing operation is started. As illustrated in FIG. 26, the returning roller drive motor 20 rotates backward (in the direction of an arrow R3). During the pressing operation of the pressing member 14, the first and second gears 21 and 22 rotate by the reverse rotation of the motor 20. Due to the one-way clutches 21*a* and 22*a*, the first shaft 19*a* stops, but the second shaft 19*b* rotates, so that the third gear 23 and the cam 24 rotate. Specifically, the third gear 23 rotates in the direction of the arrow R3, and the cam 24 rotates in the direction of the arrow R4. The pressing member 14 is operated (in the direction of an arrow R5) by the cam 24. This operation is the pressing operation of the pressing member 14. The pressing member holds the sheet or is separated from the sheet only by the reverse rotation of the returning roller drive motor 20 along the shape of the cam. The cam 24 is an eccentric cam that is mounted to rotate in synchronism with the driven gear 24*a* fixed to the first shaft 19*a*, and the rotating position corresponding to the retreating position has a plane shape (see FIGS. 27 and 28). The third gear 23 is meshed with the driven gear 24*a*, and the driven gear 24*a* is driven to rotate in one direction by the third gear 23 that rotates by the rotation of the second shaft 19*b*.

Figure 27:
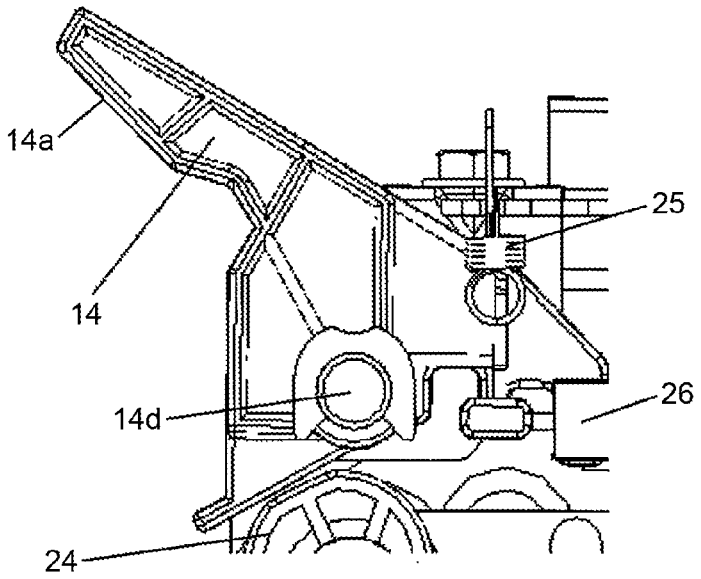
FIG. 27 is a view illustrating a structure of the leading end of the pressing member.

FIG. 27 is a view illustrating a structure of the leading end of the pressing member. FIG. 27 illustrates the pressing member at the far side viewed from the center in the conveying direction in FIG. 25. The pressing member 14 has a flat pressing portion 14*a* on its leading end, and presses the sheet stacked onto the shift tray 202. In the present embodiment, the pressing portion 14*a* becomes almost parallel to the stacking surface of the shift tray 202, when the pressing portion 14*a* presses the sheet P. The pressing portion 14*a* is not limited to have a plane. It may have a curved surface and the like.

Figure 28:
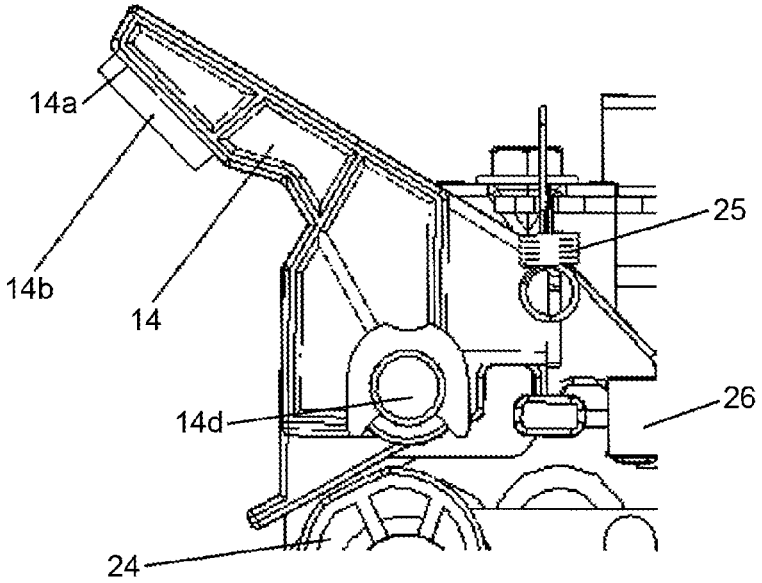
FIG. 28 is a view illustrating another structure of the leading end of the pressing member.

FIG. 28 is a view illustrating another example of the structure of the leading end of the pressing member. In this example, a cushion member 14*b* is mounted to the pressing portion 14*a*. With this structure, the pressing portion 14*a* can press the sheet P elastically, whereby the pressing portion 14*a* can respond to the change in the thickness of the sheet P or the sheet bundle PB only by the cushion member 14*b*.

Figure 29:
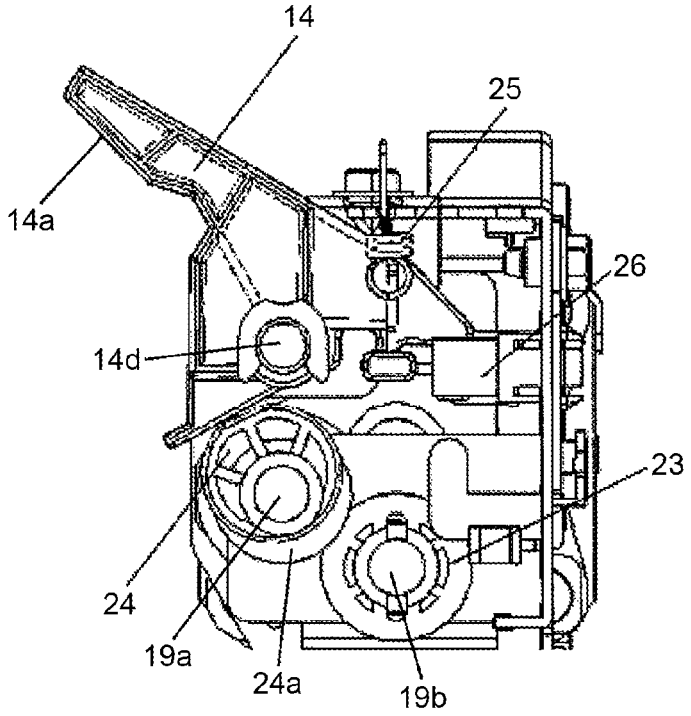
FIG. 29 is an explanatory view illustrating the state in which the pressing member is retreated.
Figure 30:
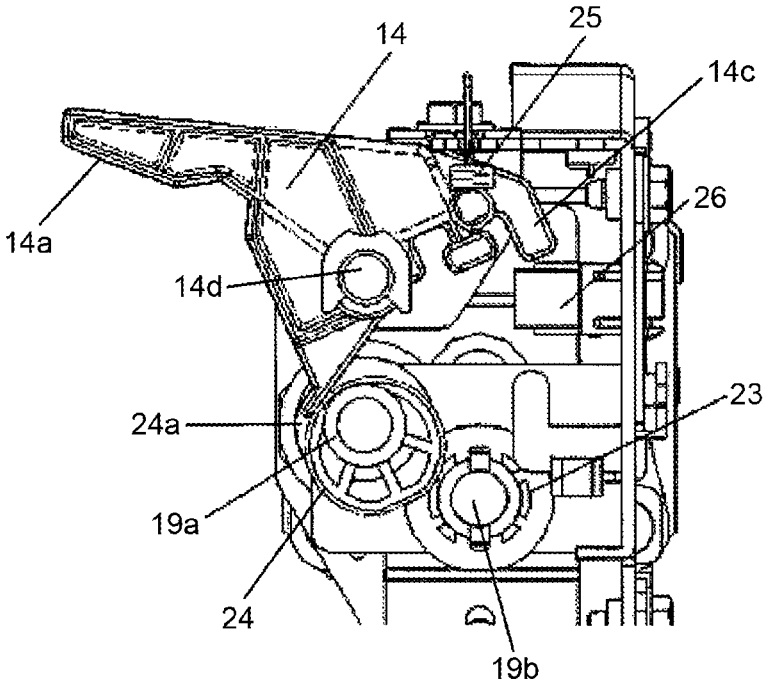
FIG. 30 is an explanatory view illustrating the state in which the pressing member performs the pressing operation.

FIGS. 29 and 30 are explanatory views illustrating the operation of the pressing member. FIG. 29 illustrates the state in which the pressing member is retreated, while FIG. 30 illustrates the state in which the pressing member performs the pressing operation. FIGS. 29 and 30 illustrate the pressing member at the far side viewed from the center in the conveying direction in FIG. 25 or 26. As illustrated in FIGS. 29 and 30, elastic force is always applied to the pressing member 14 in the retreating direction by a spring 25 serving as an elastic member. The pressing member 14 moves toward the direction of pressing the sheet P only when it is pushed by the rotation of the cam 24. The pressing member 14 also has a feeler shape 14*c*, and a transmission sensor 26 senses its home position. In the present embodiment, the home position is the retreating position illustrated in FIG. 29.

According to the driving mechanism thus configured, the preceding sheet P1 that is adhered due to the adhesion force between the sheets is held after being returned by the returning roller 13. Accordingly, excellent alignment precision can be realized. Since the returning roller 13 and the pressing member 14 are driven by the same driving source, a miniaturization and cost reduction can be attained. In this case, the changeover between the returning operation and the pressing operation can be carried out only by changing the direction of the rotation of the returning roller drive motor 20.

Figure 31:
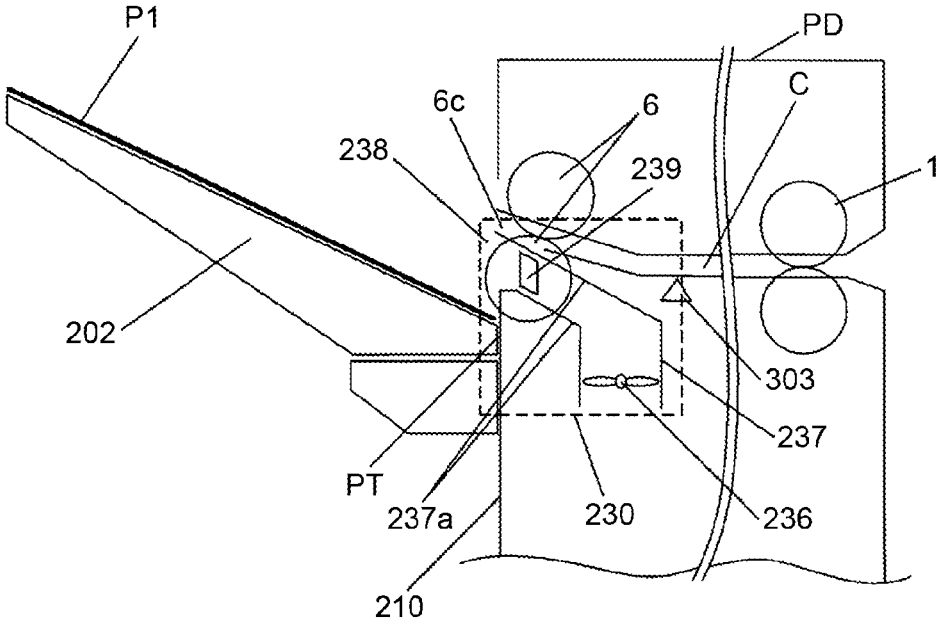
FIG. 31 is a front view illustrating a relevant portion of a discharging portion provided with a blowing device.

FIG. 31 is a front view illustrating a relevant portion of a discharging portion provided with a blowing device according to the present embodiment. The plane shape is the same as that illustrated in FIGS. 8 and 12 in the first embodiment. As is apparent from the comparison to FIG. 1, FIG. 31 does not illustrate the central portion of the sheet post-processing apparatus PD in FIG. 1 viewed from front.

A pair of blowing devices 230 is provided at the outside (on both ends) of the pair of discharging rollers 6, which are mounted on four portions in the widthwise direction of the sheet (the direction orthogonal to the sheet conveying direction D1) in FIG. 12 according to the first embodiment. As illustrated in FIG. 31, the blowing device 230 includes a blowing fan 236, a blowing duct (blowing guide) 237, and a louver 239. The blowing fan 236 is driven by a motor that is mounted on the same shaft and not illustrated, in order to send air W with wind speed according to the revolution speed of the motor from the blowing port 238 of the blowing duct 237.

The blowing port 238 is opened at the most downstream side of the blowing duct 237. As illustrated in FIG. 31, the blowing port 238 is opened below the discharging port 6*c* or the upper roller 6*a* of the pair of the discharging rollers 6, and above the shift tray 202. With this structure, air W can be sent between the stacking surface 202*b* of the shift tray 202 and the sheet P discharged from the pair of discharging rollers 6 (the lower surface of the sheet P to be discharged) (see FIG. 32). Air is sent only when the sheet passes based upon the sheet information transmitted from the image forming apparatus PR. In this case, the speed (air volume) can manually be adjusted. In the present embodiment, a pair of blowing devices 230 (two blowing devices) are provided. However, more blowing devices may be provided.

The blowing duct 237 is located below the conveying path C. It deflects the airflow sent obliquely upward by the blowing fan 236 along the shape of the blowing duct 237, thereby sending air from the blowing port 238 as described above.

Figure 32:
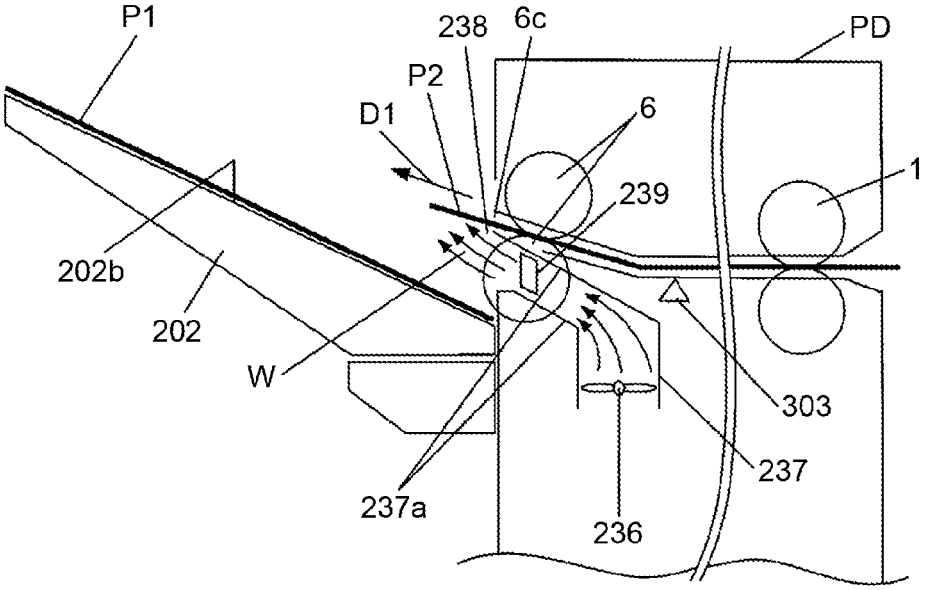
FIG. 32 is an explanatory view illustrating the operation and blowing state of the blowing device provided with a louver, and illustrates the state just after the discharge of the second sheet is started.
Figure 33:
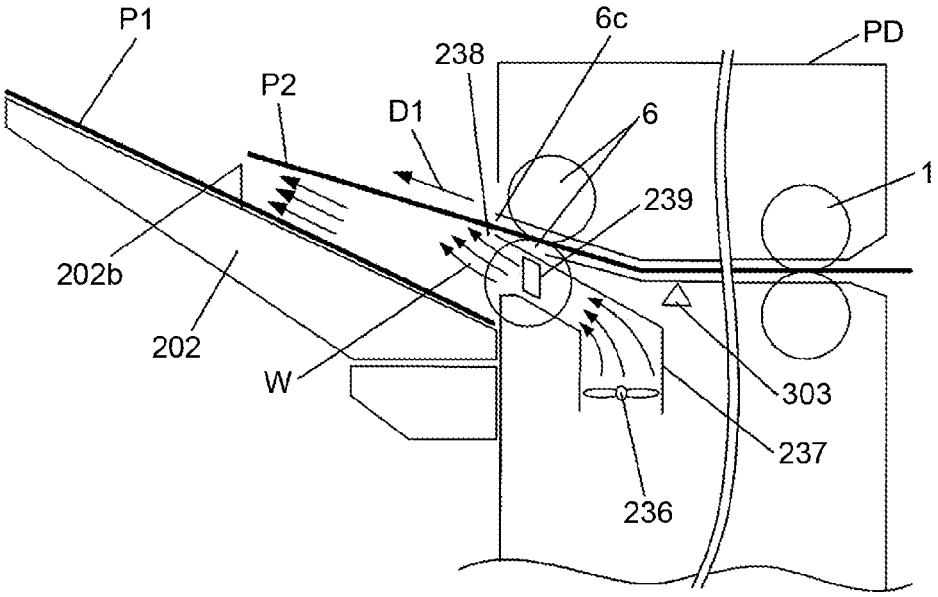
FIG. 33 is an explanatory view illustrating the state where the discharge of the sheet progresses to some extent from the state in FIG. 32.
Figure 34:
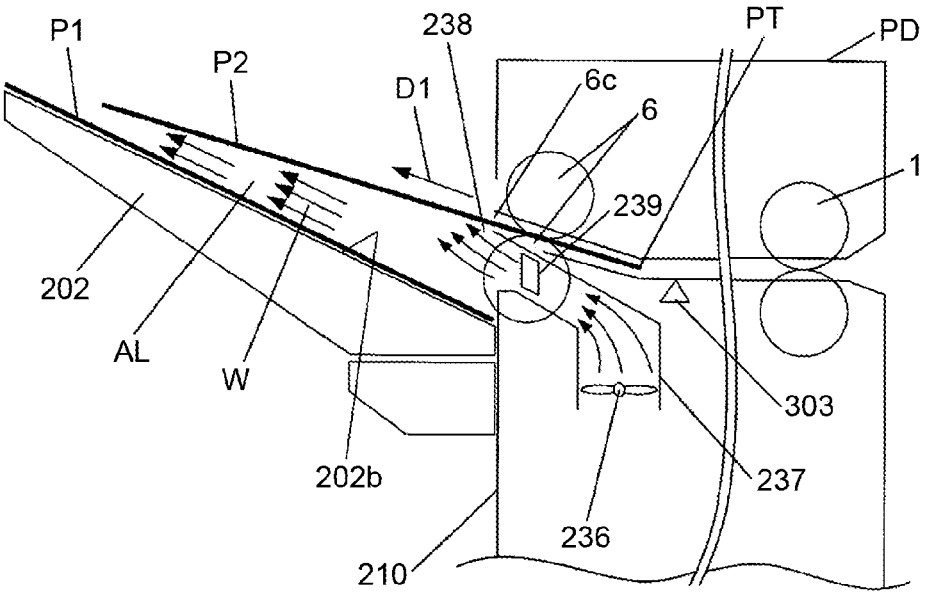
FIG. 34 is an explanatory view illustrating the state just before the discharge of the sheet is finished from the state in FIG. 33.
Figure 35:
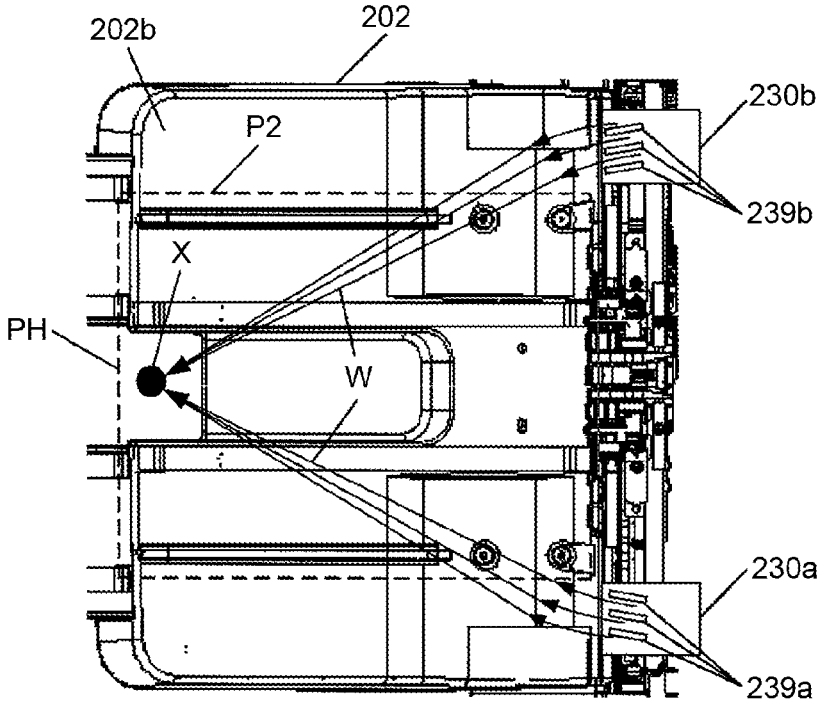
FIG. 35 is an explanatory view illustrating the direction of air from the blowing device in which a crossing point is set on the shift tray.

FIGS. 32, 33, and 34 are explanatory views illustrating the operation and blowing state of the blowing device provided with the louver, and FIG. 35 is an explanatory view illustrating the direction of air from the blowing device.

FIG. 32 illustrates the state just after the discharge of the second sheet (following sheet) P2 is started after the first sheet (preceding sheet) P1 is conveyed in the direction of an arrow D1 to be discharged onto the shift tray 202. Before this state, i.e., when the sheet P2 is discharged onto the shift tray 202, the blowing fan 236 of the blowing device 230 is driven to send air W to the back surface (lower surface) of the following sheet P2. As illustrated in FIG. 34, an air layer AL is formed between the preceding sheet P1 on the shift tray 202 and the following sheet P2 by this blowing operation. The sheet P2 is ejected from the nip of the pair of discharging rollers 6 after undergoing the state illustrated in FIG. 34, and then, drops onto the sheet P1 on the shift tray 202 as removing the air layer AL. When moving below the returning roller 13, the sheet P2 is conveyed in the direction reverse to the conveying direction by the returning roller 13, whereby the trailing end PT of the sheet abuts against the end fence 210. Thus, the sheet P is aligned in the conveying direction.

When the preceding sheet P1 is absent, and the sheet P1 is directly discharged onto the shift tray 202, air is similarly sent to the back surface of the sheet P1 to form the air layer AL between the sheet P1 and the shift tray 202 for preventing the adhesion between the sheets. In this case, the guide surface 237*a* of the blowing duct 237 in the blowing device 230 and the stacking surface 202*b* of the shift tray 202 have the same angle with respect to the horizontal direction, whereby air is sent parallel to the stacking surface 202*b* of the shift tray 202. Specifically, air W parallel to the stacking surface 202*b* is sent.

On the other hand, air W from two blowing devices 230 (230*a*, 230*b*) joins or crosses on or above an X point on the stacking surface 202*b* of the shift tray 202 as illustrated in FIG. 35. Louvers 239*a* and 239*b* of the respective blowing devices 230*a* and 230*b* are configured to have angles by which the air joins or crosses as described above. The X point where air joins or crosses is located at the downstream center of the shift tray 202 in the sheet widthwise direction. The X point may be located on any positions in the sheet conveying direction, but is desirably located on the leading end of the sheet or near the leading end. In FIG. 35, the following sheet P2 is indicated by a chain line, and FIG. 35 illustrates the state in which the crossing point X is set on the portion slightly before the leading end PH of the sheet.

Therefore, when the louver 239 is fixed, and the sheet that is most frequently used is discharged onto the shift tray 202, it is reasonable that the crossing point X is set on the position corresponding to the leading end of this sheet.

When air W is sent from the blowing devices 230*a* and 230*b* from both ends of the sheet P toward the center of the sheet P in the widthwise direction and toward the leading end of the sheet P discharged onto the shift tray 202 as described above, the air layer AL can be formed all over the sheet surface of the discharged sheet P in the widthwise direction and feeding direction. The formation of the air layer AL can effectively prevent or reduce the adhesion force between the sheets. As a result, the buckling of the following sheet P2 or the adhesion of the following sheet P2 to the preceding sheet P1 can be prevented, whereby satisfactory alignment precision can be attained.

Figure 36:
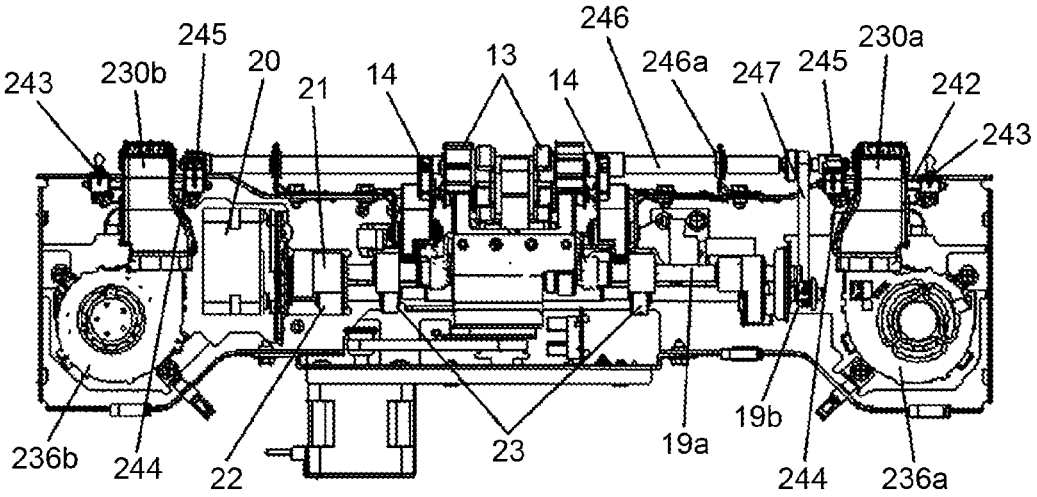
FIG. 36 is a front view illustrating a discharging unit, provided with the blowing device, the pressing member and the returning roller, viewed from the downstream side of the shift tray in the discharging direction.

FIG. 36 is a front view illustrating a discharging unit, provided with the pressing member and the returning roller, viewed from the downstream side of the shift tray in the discharging direction. In FIG. 36, first and second blowing devices 230*a* and 230*b* are provided on both sides of the discharging unit JU. The first and second blowing devices 230*a* and 230*b* respectively include fans 236*a* and 236*b*. The fans 236*a* and 236*b* are made of a scirocco fan, and they are driven by a fan motor not illustrated.

Figure 37:
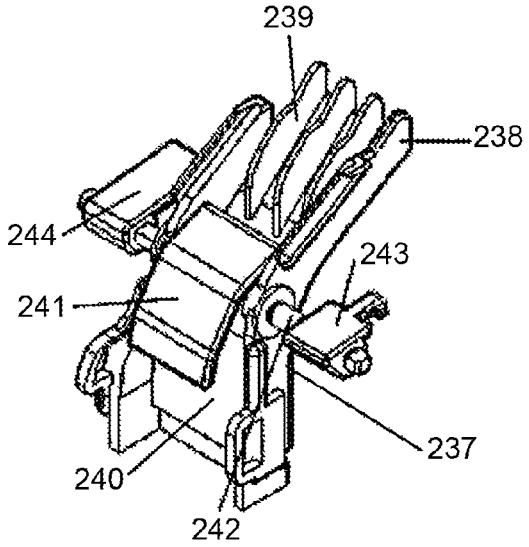
FIG. 37 is a perspective view illustrating an internal structure of the blowing port of the blowing device.

FIG. 37 is a perspective view illustrating an internal structure of the blowing port of the blowing device. In FIG. 37, the louver 239 is provided in the blowing port 238 of the first blowing device 230*a*. The louver 239 corresponds to the louver 239 illustrated in FIGS. 31 to 34. A blocking member 241 that closes a blowing path 240 in the duct 237 is provided in the duct 237 at the upstream side of the louver 239 in the blowing direction.

The blocking member 241 is assembled to a blocking member driving shaft 242 that is arranged to cross the blowing path of the blowing port 238 in the horizontal direction. An extension spring mounting member 243 is fixed to a portion of the blocking member driving shaft 242 projecting toward the outside of the discharging unit JU, and applies elastic force to the blocking member 241 by an extension spring, not illustrated, in the direction of closing the blowing path 240 at all times. A cam follower 244 for swinging the blocking member 241 is fixed to the blocking member driving shaft 242 at the side opposite to the side where the extension spring mounting member 243 is mounted. A cam 245 that drives the cam follower 244 is provided on both ends of a cam driving shaft 246.

Figure 38:
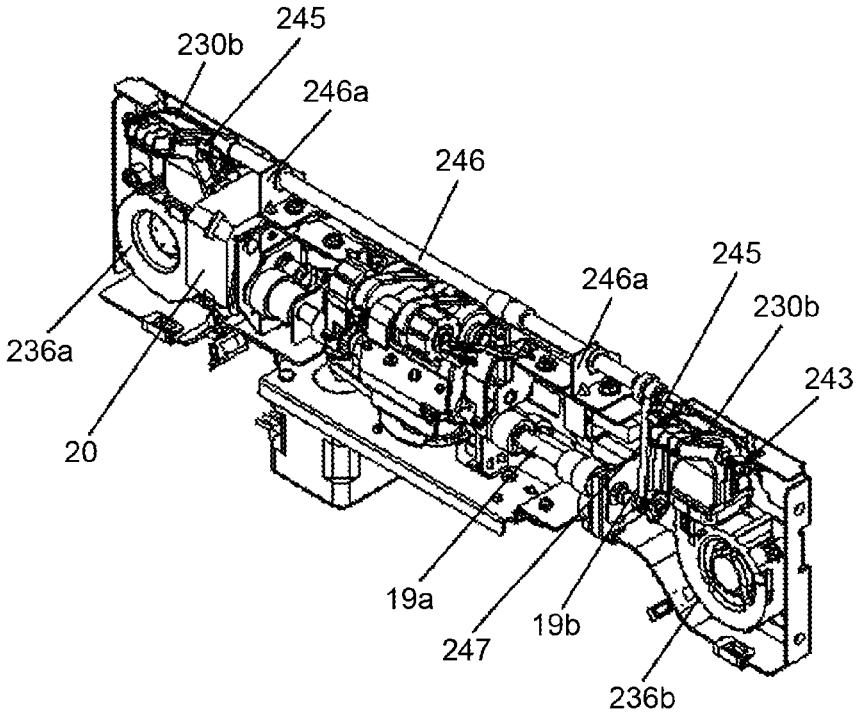
FIG. 38 is a perspective view of the discharging unit illustrated in FIG. 36 viewed from the upstream side of the shift tray in the discharging direction.
Figure 39:
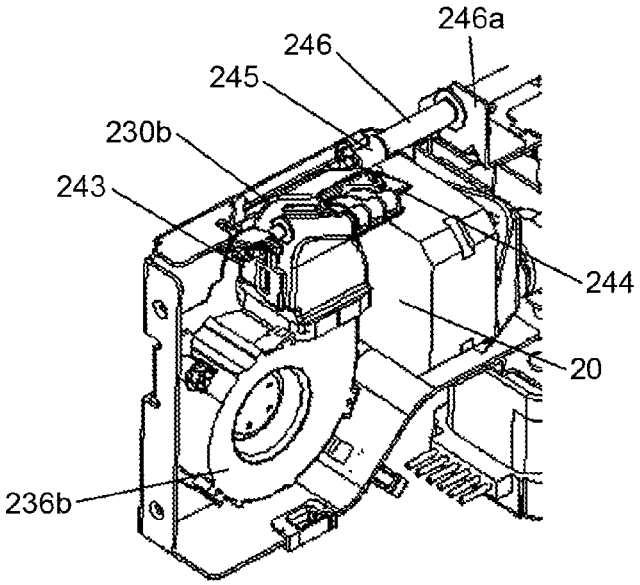
FIG. 39 is a perspective view illustrating a relevant portion of a second blowing device in FIG. 38 viewed from the upstream right side in the sheet discharging direction.
Figure 40:
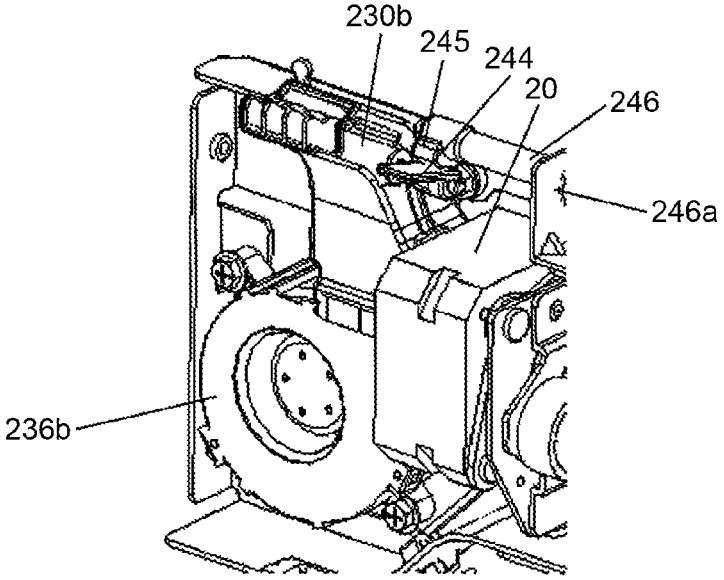
FIG. 40 is a perspective view illustrating the relevant portion of the second blowing device in FIG. 38 viewed from the upstream left side in the sheet discharging direction.
Figure 41:
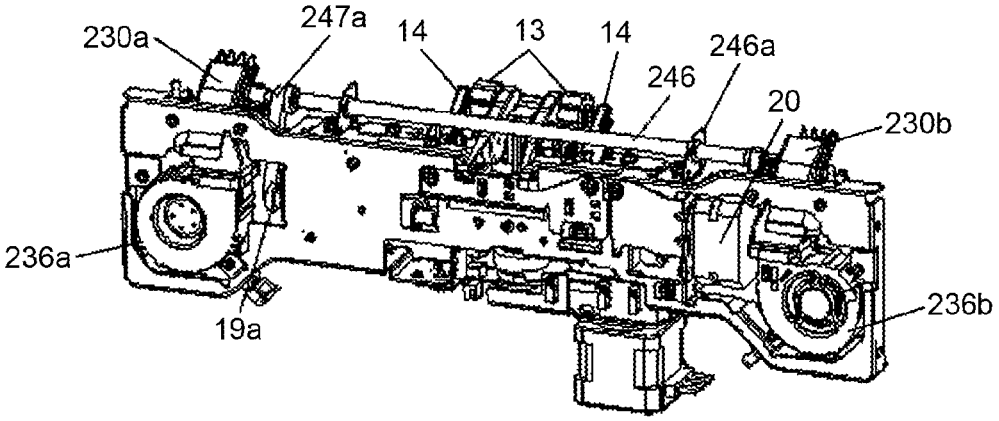
FIG. 41 is a perspective view illustrating the discharging unit viewed from the downstream side in the sheet discharging direction.
Figure 42:
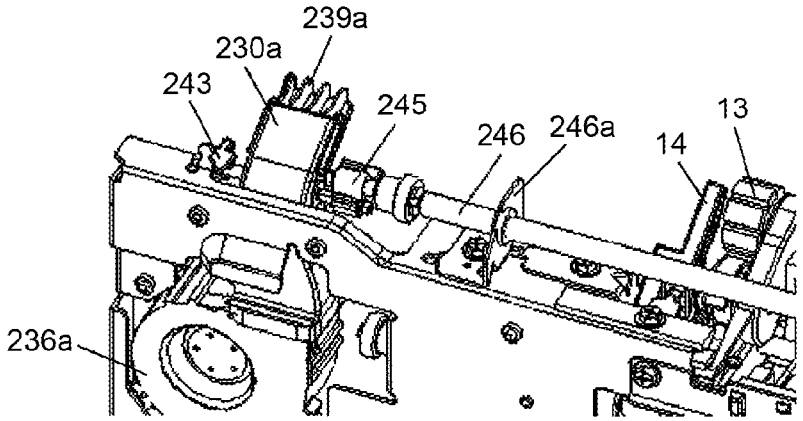
FIG. 42 is a perspective view illustrating a relevant portion of the first blowing device in FIG. 41 viewed from the right direction.
Figure 43:
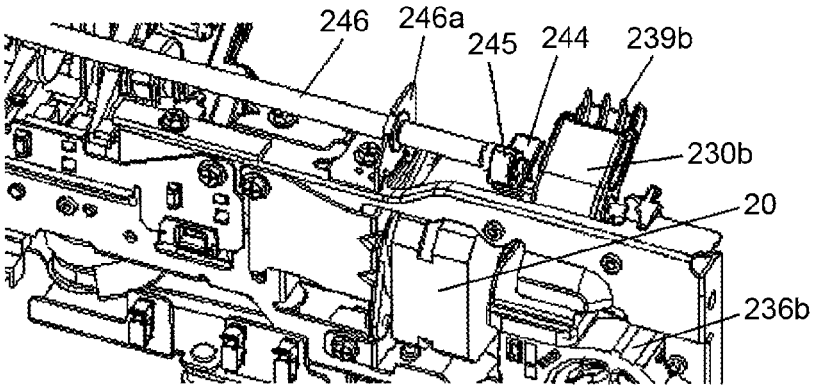
FIG. 43 is a perspective view illustrating a relevant portion of the second blowing device in FIG. 41 viewed from the right direction.

FIG. 38 is a perspective view of the discharging unit illustrated in FIG. 36 viewed from the upstream side of the shift tray in the discharging direction, FIG. 39 is a perspective view illustrating the relevant portion of the second blowing device in FIG. 38 viewed from the upstream right side in the discharging direction, FIG. 40 is a perspective view illustrating the relevant portion viewed from the left side, FIG. 41 is a perspective view illustrating the discharging unit viewed from the downstream side in the discharging direction, FIG. 42 is a perspective view illustrating the relevant portion of the first blowing device in FIG. 41 from the right side, and FIG. 43 is a perspective view illustrating the relevant portion of the second blowing device in FIG. 41 viewed from the right side.

In these figures, the cam driving shaft 246 is mounted between the first and second blowing devices 230*a* and 230*b* via a shaft bearing 246*a* at the upper part of the discharging unit JU, and the cam 245 is arranged on the position where the cam 245 can drive the cam follower 244. As apparent from FIGS. 36 and 38, the cam driving shaft 246 is driven to swing in synchronism with the second shaft 19*b* by a timing belt 247 stretched between the cam driving shaft 246 and the second shaft 19*b*. With this structure, the cam 245 pushes the cam follower 244 during the pressing operation of the pressing member 14. Thus, the blocking member driving shaft 242 pivots in the clockwise direction in FIG. 37, and the blocking member 241 pivots in the clockwise direction in synchronism with the pivot of the blocking member driving shaft 242. Accordingly, the blowing path 240 is opened (see (a) of FIG. 44).

The second shaft 19*b* is driven by the returning roller drive motor 20 through the first shaft 19*a*. Therefore, the returning roller drive motor 20 drives the returning roller 13, the pressing member 14, and the blocking member 241. Specifically, the driving source of the blocking member 241 is the same as the driving source of the returning roller 13 and the pressing member 14. With this structure, during the operation of the returning roller 13, the blocking member 241 is not operated (closed state). On the other hand, during the operation of the pressing member 14, the returning roller 13 does not rotate, but the blocking member 241 of the blowing devices 230*a* and 230*b* opens the blowing path 240 in synchronism with the operational timing of the pressing member 14.

The pressing member 14 prevents the stacked sheet from being pushed out by pressing the trailing end of the sheet P stacked onto the shift tray 202 during the discharge of the sheet to be discharged. The blocking member 241 is operated on the same operational timing of the pressing member 14, in order that air is sent from the blowing device 230 during when the discharged sheet is discharged by the pair of discharging rollers 6. After the trailing end of the discharged sheet completely passes through the discharging rollers 6, the blocking member 241 is returned to the initial position to close the blowing path 240.

The blocking member 241 is opened and closed by the structure in which the cam driving shaft 246 is driven by the timing belt 247 from the second shaft 19*b* that drives the pressing member 14, and the cam follower 244 is driven by the cam 245 mounted on both ends of the cam driving shaft 246, as described above. Accordingly, the driving mechanism including the driving source of the returning roller 13 can be used, and the pressing member 14 and the blocking member 241 can be driven in synchronism with each other by a simple system.

Figure 44:
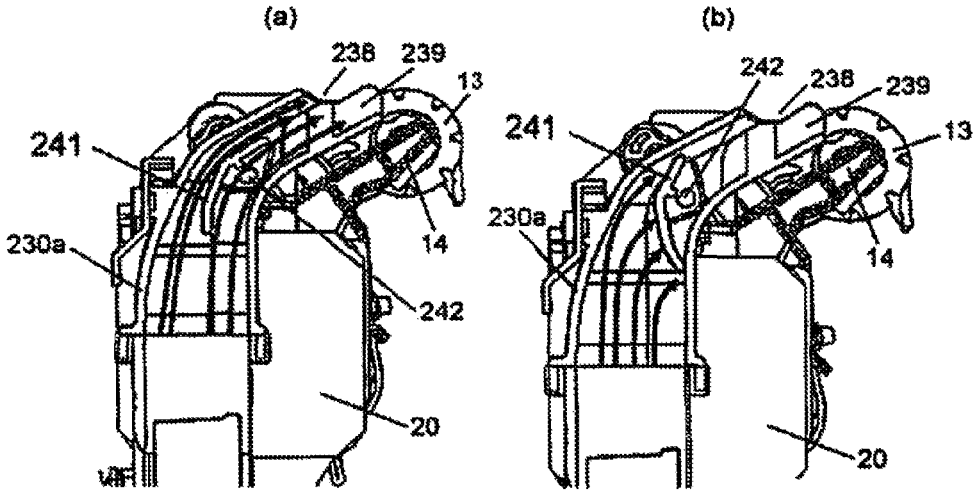
FIG. 44 illustrates the blowing operation and the closed state in the blowing device illustrated in FIG. 37.

FIG. 44 is an explanatory view illustrating the blowing operation and the closed state in the blowing device illustrated in FIG. 37. The blowing state is illustrated in (a) of FIG. 44 and the closed state is illustrated in (b) of FIG. 44.

The blocking member 241 is formed to have a sectional shape similar to the sectional shape of the duct 237 as illustrated in (a) of FIG. 44. Therefore, in the blowing operation in which the blocking member 241 is opened, the blocking member 241 functions as a flow control plate. Therefore, air sent from the fan 236 is smoothly blown from the blowing port 238 as having a flow line along the sectional shape of the blowing duct 237.

On the other hand, when the blocking member 241 is closed, the blocking member 241 rotates in the direction orthogonal to the flow of the air so as to close the blowing path 240 at the back side of the blocking member 241 as illustrated in (b) of FIG. 44. In this case, the blocking member 241 does not completely close the blowing path, but closes the blowing path in such a manner that the air volume is reduced to some degree by which the following sheet to be discharged is not lifted up. Accordingly, excess current does not flow through the fan motor driving the fan 236, whereby any trouble is not caused on the discharging unit JU according to the air volume control by the blocking member 241.

When air W is sent from the blowing device 230 on both ends of the sheet P toward the center of the sheet P in the widthwise direction and toward the leading end of the sheet P discharged onto the shift tray 202 as described above, the air layer AL can be formed all over the sheet surface of the discharged sheet P in the widthwise direction and feeding direction. The formation of the air layer AL can effectively prevent or reduce the adhesion force between the sheets. As a result, the buckling of the following sheet P2 or the adhesion of the following sheet P2 to the preceding sheet P1 can be prevented, whereby satisfactory alignment precision can be attained.

Since the volume of air sent from the blowing device 230 after the discharge of the sheet can be reduced by the blocking member 241, the lift of the trailing end of the discharged following sheet can also be prevented. The prevention of the lift leads to the enhancement of the alignment precision.

In the present embodiment, the blowing control is also executed by the configuration same as that in the image forming system illustrated in FIG. 15.

As described above, a blowing mode for sending air to the back surface (lower surface) of the sheet from the blowing device 230 is set in the present embodiment. The blowing mode is turned ON when a user selects a coat paper on the operation panel 105. However, air is not sent even if a sheet is a coat paper, when a user selects a forced OFF. In the case of a plain paper, air is not sent in default, but air can be sent by selecting a forced ON.

Figure 45:
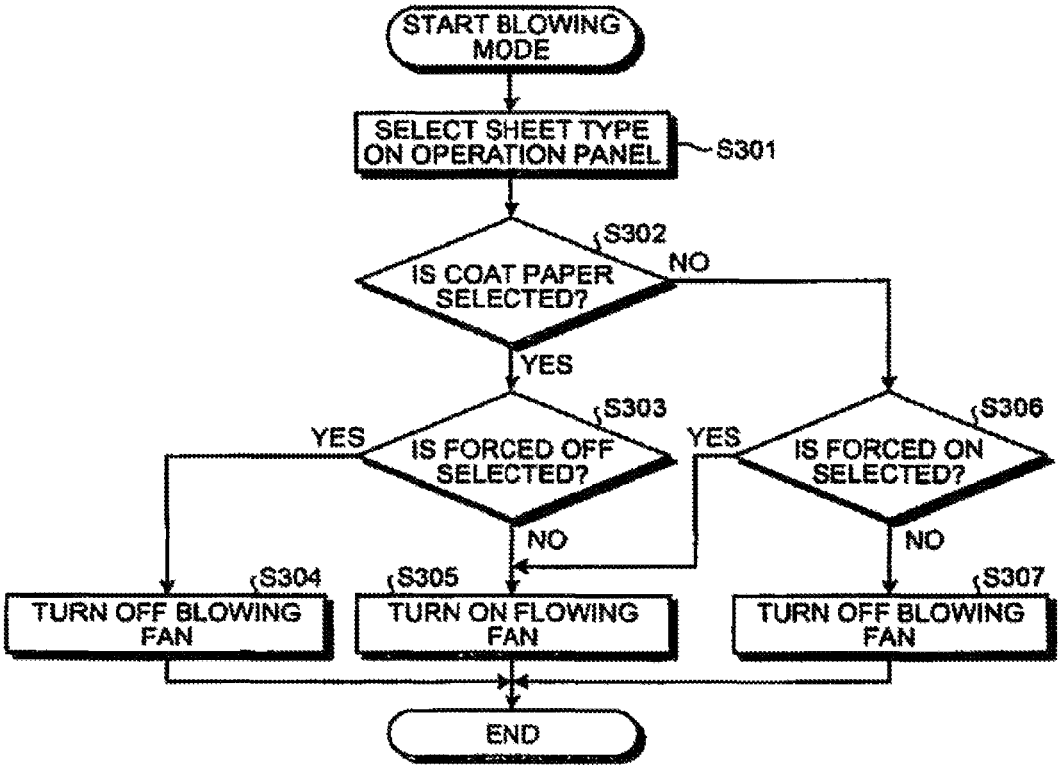
FIG. 45 is a flowchart illustrating the procedure of the blowing operation in a blowing mode.
Figure 46:
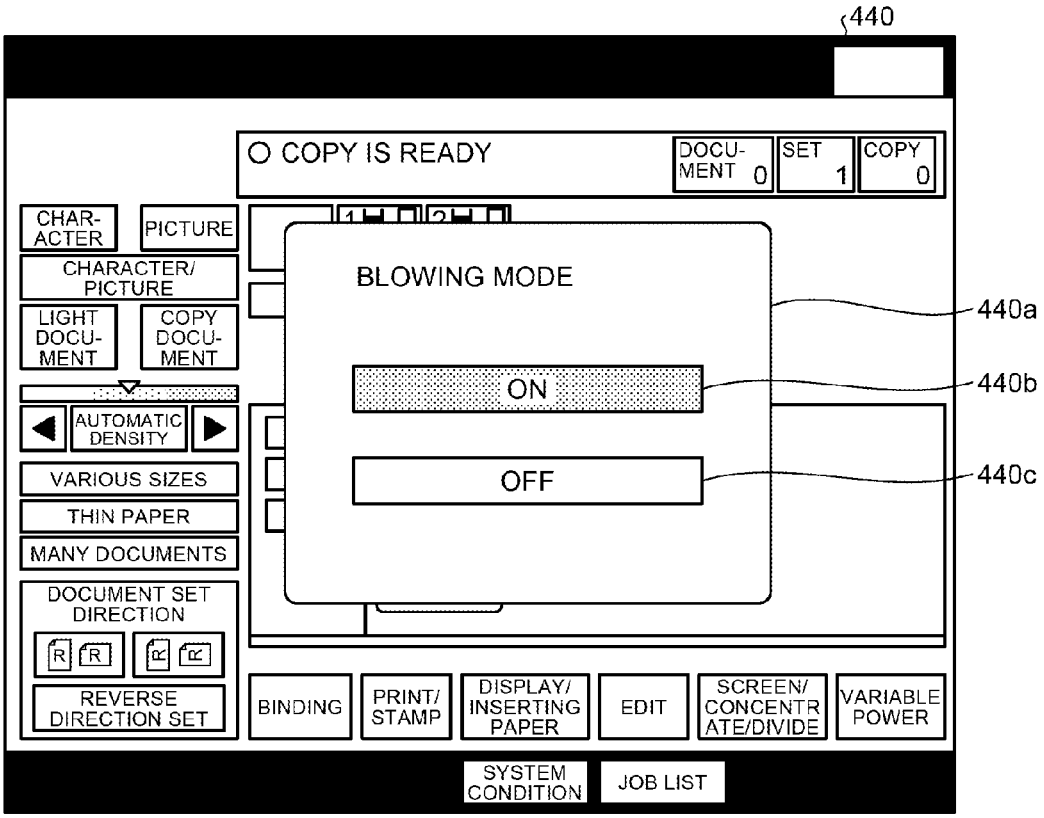
FIG. 46 is a view illustrating a selection screen on an operation display unit during a process of selecting the blowing mode.

FIG. 45 is a flowchart illustrating the procedure of the blowing operation in the blowing mode, and FIG. 46 is a view illustrating a selection screen on the operation display unit (operation panel) during when the blowing mode is selected. The process illustrated in this flowchart is executed by the CPU 401 in the sheet post-processing apparatus PD.

In the process of selecting the blowing mode, the process of the blowing mode is started when a user selects "ON" 440*b* from the selection screen 440*a* of the blowing mode on the operation display unit 440 in FIG. 46. When the process of the blowing mode is selected, the operation screen on the operation display unit 440 is changed to a selection screen, not illustrated, for a type of sheet Although not illustrated, a type of sheet is displayed as a selection button on this selection screen. When the type of sheet is selected (step S301), and a coat paper is selected (step S302: YES), the screen is changed to a selection screen for a forced blowing OFF.

Specifically, when a coat paper is selected, it is set such that the blowing fan 230 is turned ON. Therefore, before the blowing fan 230 is turned ON, it is determined whether the forced OFF of the blowing fan 230 is selected or not (step S303). When the forced OFF is selected (step S303: YES), the blowing fan 230 is turned OFF (step S304), and then, the CPU 401 exits the routine.

When the forced OFF is not selected (step S303: NO), the blowing fan 230 is turned ON (step S305) to generate airflow (air W), and then, the CPU 401 exits the routine.

The blowing OFF is set in the default for a sheet other than the coat paper. Therefore, the CPU 401 also determines whether the forced blowing OFF is selected or not (step S306). When the forced blowing OFF is selected (step S306: YES), the blowing fan 230 is turned ON (step S305). When the forced blowing OFF is not selected (step S306: NO), the blowing fan 230 is turned OFF (step S307), and then, the CPU 401 exits the routine.

When the user selects "OFF" 440*c* on the blowing mode screen, the blowing mode is not started, and the general discharge process is executed.

In the present embodiment, when the user selects the sheet-type information on the operation display unit 440, the blowing mode is turned ON. When the user selects the forced OFF, air is not sent. In the case of a plain paper, air is not sent in the default. However, air can be sent when the user selects the forced ON.

The units not particularly described are configured to be the same as those in the first embodiment, and function similarly.

As described above, the present embodiment can provide effects described below.

1) In the present embodiment, the discharging portion J or the discharging unit JU (sheet discharging device) includes the discharging roller 6 (discharging unit) that discharges the sheet P, the blowing device 230 (blowing unit) that sends air to the lower surface of the sheet P discharged by the discharging roller 6, blocking members 231 and 241 (blocking unit) that blocks the blow of air to the lower surface of the sheet P from blowing ports 230-2 and 238 of the blowing device 230, and the CPU 401 (control unit) that controls the operation of the blocking members 231 and 241.

With this structure, the blowing timing is set by the control of the operation of the blocking members 231 and 241 for sending air; air can be sent with the blowing timing being set, whereby satisfactory stacking property can be attained upon discharging a sheet; the blowing port 230-2 can be opened and closed by the blocking member 231, and the blowing port 238 can be opened and closed by the blocking member 241, so that the intrusion of foreign matters into the blowing ports 230-2 and 238 can be prevented; the intrusion of foreign matters can be prevented, so that malfunction caused by the intrusion of foreign matters can be prevented from occurring.

2) The sheet discharging device further includes the shift tray 202 (tray unit) on which the sheet P discharged by the discharging roller 6 is stacked, and the blowing device 230 is provided near both ends of the shift tray 202 in the direction orthogonal to the discharging direction. Accordingly, air can be sent from both ends on the trailing end of the discharged sheet, whereby the satisfactory air layer AL can be formed between the preceding sheet P1 and the following sheet P2, and between the preceding sheet P1 and the stacking surface 202*b* of the shift tray 202. Consequently, the adhesion and buckling of the sheet P can surely be prevented, whereby satisfactory alignment precision can be attained.

3) The blowing direction of the blowing devices 230*a* and 230*b* provided near both ends is set to cross on or above the shift tray 202. Therefore, air (airflow) W crosses on the lower surface of the sheet P, so that the air layer AL having sufficient thickness can be formed about the crossing point. Accordingly, the effect described in 2) can more effectively be attained.

4) The position X where the blowing direction crosses each other is set on the center of the shift tray 202 in the widthwise direction. Therefore, air (airflow) W crosses on the lower surface of the sheet P, so that the air layer AL having sufficient thickness can be formed about the crossing point. Accordingly, the effect described in 2) can more effectively be attained.

5) The position X where the blowing direction crosses each other is set on the leading end of the sheet P discharged onto the shift tray 202. Therefore, the air layer AL can surely be formed on all over the discharged sheet P in the longitudinal direction. Accordingly, the effect described in 2) can more surely be attained.

6) The louver 239*a* that regulates the blowing direction toward the center of the shift tray 202 in the sheet widthwise direction is provided to the blowing device 230. Therefore, the direction of air W can be set with a simple mechanism.

7) The blowing device 230 includes the blowing duct 237, and the guide surface (blowing guide) 237*a* of the blowing duct 237 is arranged parallel to the stacking surface 202*b* of the shift tray 202. Therefore, air W can be sent from the blowing device 230 as air parallel to the stacking surface 202*b*. Accordingly, the satisfactory air layer AL can be formed, and the effect described in 2) can more effectively be attained.

8) The sheet discharging device includes the returning roller 13 (conveying unit) that conveys the sheet P stacked onto the shift tray 202 in the direction reverse to the sheet discharging direction; the pressing member 14 (pressing unit) that presses the conveyed sheet P; and a driving unit that drives the returning roller 13 and the pressing member 14 by the returning roller drive motor 20 (same driving source). Therefore, the preceding sheet P1 can be held by the pressing member 14, and the following sheet can be returned by the returning roller 13 with the single driving source, when the following sheet P2 is discharged. This structure can prevent the preceding sheet from being pushed out due to the adhesion between the sheets by static electricity, whereby satisfactory alignment precision can be attained. Since the returning roller 13 and the pressing member 14 are driven by the same driving source, the device can be made compact without an increase in size.

9) The CPU 401 (control unit) operates the blocking members 231 and 241 in accordance with the discharging operational timing of the sheet. Therefore, air can be sent only when the sheet is discharged. Thus, the stacking property can be enhanced.

10) The blocking member is in the closed state during the stand-by state of the sheet discharge, which can prevent foreign matters from entering the blowing ports 230-2 and 238 during the stand-by state.

11) When the sheet P is discharged by the discharging roller 6, the blocking members 231 and 241 are set to send air in a predetermined volume, and after the sheet P completely passes through the discharging roller 6, the air blow is stopped, or the air volume is reduced. Specifically, air is sent with an appropriate volume to form the air layer AL only during the discharging operation, and after the discharging operation is finished, the formation of the air layer AL is stopped, or the air blow to the trailing end of the sheet P to be discharged is stopped. Thus, satisfactory stacking property can be secured.

12) The effect described in 1) can be attained only by a simple structure in which the blocking member 231 moves up and down.

13) Since the blocking member 241 is arranged at the inside of the blowing port 238 so as to be rotatable, the effect described in 1) can be attained without allowing a person on the outside to notice the presence of the blocking member.

14) Since the blocking member 241 is arranged at the inside of the blowing port 238 so as to be rotatable, and the returning roller drive motor 20 (same driving source) drives not only the returning roller (conveying unit) and the pressing member 14 but also the blocking member 241, the pressing member can prevent the sheet from being pushed out due to the adhesion between the sheets by static electricity, and air can be sent from the blowing device 230 in synchronism with the blocking member 241. As a result, satisfactory alignment precision can be attained. Since the returning roller 13, the pressing member 14, and the blocking member 241 are driven by the same driving source, the device can be made compact without an increase in size.

15) The device includes the first and second gears 21 and 22 and the one-way clutches 21*a* and 22*a* (changeover unit) that change the operations of the returning roller 13, the pressing member 14, and the blocking member 241 according to the rotating direction of the returning roller drive motor 20. Therefore, the changeover of the operations can be made with a simple structure.

16) The driving mechanism 18 (driving unit) includes the pressing member 14 that is driven by the cam 24 that is driven by the first shaft 19*a*, the second gear 22 that is mounted to the second shaft 19*b* driving the cam 24, and the first gear 21 that transmits the rotation of the first shaft 19*a* to the second shaft 19*b*; the conveying unit includes the returning roller 13 that is mounted to the first shaft 19*a* and that rotates in synchronism with the first shaft 19*a*; and the blocking member includes the cam driving shaft 246 (first driving shaft) that pivots in synchronism with the second shaft 19*b* through the timing belt 247 (power transmitting unit) from the second shaft 19*b*, and the blocking member 241 that is mounted to the blocking member driving shaft 242 (second driving shaft) that pivots with the cam driving shaft 246, wherein the one-way clutches 21*a* and 22*a* (changeover unit) lock when the first gear 21 and the second gear 22 rotate in different direction. Therefore, the alignment operation by the returning roller 13, and the pressing operation by the pressing member 14 as well as the blowing control operation by the blocking member 241 can be changed with a simple structure.

17) The CPU 401 of the sheet post-processing apparatus PD determines the blocking amount of the sent air based upon the sheet information including at least the sheet-type information, the sheet-size information, and the sheet-thickness information transmitted from the image forming apparatus PR, and operates the blocking members 231 and 241. Therefore, air volume corresponding to the sheet to be discharged can be set, whereby the effect described in 2) can more effectively be attained.

18) The device includes a setting unit by which an operator sets the blocking amount of air by the blocking members 231 and 241 on the operation display unit 440. Therefore, the air volume corresponding to the operator's intention can be set (FIGS. 45, 46).

The sheet in the claims corresponds to the sheets P1 and P2 (P1: stacked sheet, preceding sheet, P2: discharged sheet, following sheet), the tray unit corresponds to the shift tray 202, the discharging unit corresponds to the discharging roller 6, the air blower corresponds to the blowing devices 230, 230*a*, and 230*b*, the blowing port corresponds to the blowing ports 230-2 and 238, the blocking member corresponds to the blocking members 231 and 241, the control unit corresponds to the CPU 401, the operation unit corresponds to the operation display unit 440, the sheet discharging device corresponds to the discharging portion J or the discharging unit JU, the stacking surface corresponds to the stacking surface 202*b*, the air layer corresponds to the air layer AL, the crossing point corresponds to the crossing point X, the louver corresponds to the louvers 239, 239*a*, and 239*b*, the blowing duct corresponds to the blowing duct 237, the blowing guide corresponds to the guide surface 237*a*, the conveying unit corresponds to the returning roller 13, the pressing unit corresponds to the pressing member 14, the driving source corresponds to the returning roller drive motor 20, the first gear corresponds to the first gear 21, the second gear corresponds to the second gear 22, the changeover unit corresponds to the one-way clutches 21*a* and 22*a*, the cam corresponds to the cam 24, the first shaft corresponds to the first shaft 19*a*, the second shaft corresponds to the second shaft 19*b*, the power transmitting unit corresponds to the timing belt 247, the first driving shaft corresponds to the cam driving shaft 246, the second driving shaft corresponds to the blocking member driving shaft 242, the operation display unit corresponds to the operation display unit 440, and the image forming system corresponds to the system including the sheet post-processing apparatus PD provided with the discharging portion J or the discharging unit JU and the image forming apparatus PR in the present embodiment.

According to the embodiments, it is possible to realize satisfactory stacking property upon discharging a sheet by blowing air, and prevent foreign matters from entering a blowing port.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet discharging device comprising:

a discharging unit configured to discharge a sheet;

a tray unit configured to receive a sheet discharged by the discharging unit a pressing member configured to press the received sheet on the tray unit;

a driving unit configured to drive the pressing member;

an air blower arranged below the discharging unit;

a blocking unit arranged in a duct of the air blower so as to selectively block the duct; and a controller configured to control operation of the blocking unit such that during operation of the pressing member the blocking unit is in an open state and further configured to drive the pressing member against the received sheet.

2. The sheet discharging device according to claim 1, wherein the air blower includes blowing ports provided near both ends of the tray unit in a direction orthogonal to a direction in which the sheet is discharged.

3. The sheet discharging device according to claim 2, wherein blowing directions of the blowing ports provided near the both ends cross on or above the tray unit.

4. The sheet discharging device according to claim 3, wherein the blowing directions of the blowing ports provided near the both ends cross on a center portion of the tray unit in a widthwise direction of the tray unit.

5. The sheet discharging device according to claim 3, wherein the blowing directions of the blowing ports provided near the both ends cross on a leading end of the sheet discharged onto the tray unit.

6. The sheet discharging device according to claim 2, further comprising a louver provided in the air blower to regulate a blowing direction of the air toward a center portion of the tray unit in a widthwise direction of the sheet.

7. The sheet discharging device according to claim 2, wherein the air blower includes a blowing guide arranged parallel to a stacking surface of the tray unit.

8. The sheet discharging device according to claim 2, further comprising:

a conveying unit configured to convey the sheet stacked on the tray unit in a direction reverse to the sheet discharging direction wherein the pressing member is further configured to press the conveyed sheet and the driving unit is further configured to drive the conveying unit and the pressing member by a same driving source.

9. The sheet discharging device according to claim 8, wherein the driving unit drives not only the conveying unit and the pressing member but also the blocking unit by the same driving source.

10. The sheet discharging device according to claim 9, wherein the driving unit includes a changeover unit configured to change operations of the conveying unit, the pressing member, and the blocking unit in accordance with a rotating direction of the driving source.

11. The sheet discharging device according to claim 10, wherein the pressing member is driven by a cam mounted to a first shaft, a second gear mounted to a second shaft for driving the cam, and a first gear for transmitting a rotation of the first shaft to the second shaft, the conveying unit is a returning roller configured to rotate in synchronism with the first shaft, the returning roller being mounted to the first shaft, the blocking unit includes a first driving shaft configured to pivot in synchronism with the second shaft through a power transmitting unit from the second shaft, and a blocking member mounted to a second driving shaft configured to swing with the first driving shaft, and the changeover unit includes a one-way clutch configured to lock when the first gear and the second gear rotate in different directions.

12. An image forming system comprising the sheet discharging device according to claim 1.

13. The sheet discharging device according to claim 1, further comprising:

a conveying unit configured to convey the sheet stacked on the tray unit in a direction reverse to a direction in which the sheet is discharged, wherein the controller controls operation of the blocking unit such that during operation of the pressing member the blocking unit is in an open state and during rotation of the conveying unit the blocking unit is in a closed state.

14. The sheet discharging device according to claim 1, wherein the blocking unit is rotatable.

15. The sheet discharging device according to claim 1, wherein the pressing member presses the received sheet, only when the received sheet is a coat paper.

16. A sheet discharging device comprising:

a discharging unit configured to discharge a sheet;

a pressing member configured to press the discharged sheet;

an air blower arranged below the discharging unit;

a blocking unit arranged in a duct of the air blower so as to selectively block the duct;

a controller configured to control operation of the blocking unit; and a driving unit configured to drive the pressing member and the blocking unit by a same driving source.

17. The sheet discharging device according to claim 16, further comprising:

a tray unit to receive a sheet discharged by the discharging unit;

a conveying unit configured to convey the sheet stacked on the tray unit in a direction reverse to a direction in which the sheet is discharged; and a pressing unit configured to press the conveyed sheet, wherein the driving unit drives the conveying unit, the pressing unit, and the blocking unit by a same driving source.

18. The sheet discharging device according to claim 17, wherein the driving unit includes a changeover unit configured to change operations of the conveying unit, the pressing unit, and the blocking unit in accordance with a rotating direction of the driving source.

19. An image forming system comprising the sheet discharging device according to claim 16.

* * * * *